US007386241B2

(12) United States Patent
Mori et al.

(10) Patent No.: US 7,386,241 B2
(45) Date of Patent: Jun. 10, 2008

(54) PROCESSING CARTRIDGE ROTATING A DRUM SHAFT IN DIFFERENT DIRECTIONS AND IMAGE FORMING APPARATUS MOUNTING SUCH A CARTRIDGE

(75) Inventors: Tomonori Mori, Numazu (JP); Susumu Nittani, Shizuoka-ken (JP); Tadashi Horikawa, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 174 days.

(21) Appl. No.: 11/346,174

(22) Filed: Feb. 3, 2006

(65) Prior Publication Data

US 2006/0177231 A1 Aug. 10, 2006

(30) Foreign Application Priority Data

Feb. 4, 2005 (JP) ..... 2005-029891
Feb. 1, 2006 (JP) ..... 2006-024062

(51) Int. Cl.
*G03G 21/18* (2006.01)

(52) U.S. Cl. ..... 399/12

(58) Field of Classification Search ..... 399/12, 399/24, 25, 26

See application file for complete search history.

(56) References Cited

U.S. PATENT DOCUMENTS 3,689,146 A * 9/1972 Ito et al. ..... 399/110
4,551,000 A 11/1985 Kanemitsu et al. ..... 355/3 R
4,771,313 A * 9/1988 Kuroda et al. ..... 399/25
5,528,341 A 6/1996 Shishido et al. ..... 355/200
5,642,187 A 6/1997 Nomura et al. ..... 399/111
5,650,841 A 7/1997 Matsuda et al. ..... 399/111
5,678,139 A 10/1997 Nomura et al. ..... 399/114
5,697,022 A 12/1997 Matsuda et al. ..... 300/102
5,825,472 A 10/1998 Araki et al. ..... 355/200
5,867,751 A 2/1999 Nomura et al. ..... 399/90
6,016,408 A 1/2000 Hashimoto et al. ..... 399/27
6,101,352 A 8/2000 Hashimoto et al. ..... 399/119
6,151,459 A 11/2000 Hashimoto et al. ..... 399/27
6,157,792 A 12/2000 Mori et al. ..... 399/24
6,266,503 B1 7/2001 Murayama et al. ..... 399/117
6,272,300 B1 8/2001 Fujiwara et al. ..... 399/113

(Continued)

FOREIGN PATENT DOCUMENTS

JP 57-163276 A 10/1982

(Continued)

*Primary Examiner*—Quana M Grainger
(74) *Attorney, Agent, or Firm*—Fitzpatrick, Cella, Harper & Scinto

(57) ABSTRACT

A process cartridge detachably mountable to a main assembly of an electrophotographic image forming apparatus for forming an image on a recording material, the process cartridge includes an electrophotographic photosensitive drum; a drum shaft for being rotated by a driving force supplied from the main assembly of the apparatus and for transmitting a rotating force to the electrophotographic photosensitive drum; and a notification member, movably provided on the drum shaft, for notifying, when the process cartridge is mounted to the main assembly of the apparatus, that process cartridge has reached at least a state that process cartridge has been used for image formation, wherein when the main assembly of the apparatus detects that process cartridge has reached the state, the drum shaft is rotated in a direction opposite to a rotational direction for the image formation to make the notification.

8 Claims, 19 Drawing Sheets

U.S. PATENT DOCUMENTS

| | | | | |
|---|---|---|---|---|
| 6,324,370 | B1 | 11/2001 | Isobe et al. | 399/258 |
| 6,385,416 | B1 | 5/2002 | Horikawa et al. | 399/111 |
| 6,459,869 | B2 | 10/2002 | Nittani et al. | 399/111 |
| 6,463,234 | B2 | 10/2002 | Arimitsu et al. | 399/113 |
| 6,546,212 | B1 | 4/2003 | Ogata et al. | 399/24 |
| 6,564,029 | B2 | 5/2003 | Kojima et al. | 399/258 |
| 6,584,291 | B1 | 6/2003 | Yamamoto | 399/27 |
| 6,587,649 | B1 | 7/2003 | Yamamoto et al. | 399/27 |
| 6,594,451 | B2 | 7/2003 | Kakeshita et al. | 399/24 |
| 6,681,088 | B2 | 1/2004 | Kanno et al. | 399/111 |
| 6,826,380 | B2 | 11/2004 | Karakama et al. | 399/111 |
| 6,834,171 | B2 | 12/2004 | Nittani et al. | 399/103 |
| 6,892,033 | B2 | 5/2005 | Sunada et al. | 399/13 |
| 6,912,366 | B1 | 6/2005 | Yamamoto et al. | 399/27 |
| 6,925,267 | B2 | 8/2005 | Yamamoto et al. | 399/27 |
| 6,968,147 | B2 | 11/2005 | Matsuda et al. | 399/258 |
| 6,980,758 | B2 | 12/2005 | Murayama et al. | 399/111 |
| 6,980,759 | B2 | 12/2005 | Kanno et al. | 399/111 |
| 7,024,137 | B2 | 4/2006 | Nittani et al. | 399/222 |
| 7,072,603 | B2 | 7/2006 | Tsuzuki et al. | 399/111 |
| 7,082,276 | B2 | 7/2006 | Karakama et al. | 399/111 |
| 7,088,939 | B2 | 8/2006 | Maeshima et al. | 399/111 |
| 7,174,116 | B2 * | 2/2007 | Ikebata | 399/110 |
| 2005/0053393 | A1 | 3/2005 | Harada et al. | 399/106 |
| 2005/0152716 | A1 | 7/2005 | Agata et al. | 399/223 |
| 2005/0220464 | A1 | 10/2005 | Kobayashi et al. | 399/27 |
| 2005/0260011 | A1 | 11/2005 | Murayama et al. | 399/111 |
| 2006/0013618 | A1 | 1/2006 | Nittani et al. | 399/222 |
| 2006/0127128 | A1 | 6/2006 | Horikawa | 399/111 |
| 2006/0177231 | A1 | 8/2006 | Mori et al. | 399/112 |
| 2006/0245784 | A1 | 11/2006 | Tsuzuki et al. | 399/111 |
| 2006/0245785 | A1 | 11/2006 | Kawamura et al. | 399/111 |

FOREIGN PATENT DOCUMENTS

| | | | |
|---|---|---|---|
| JP | 9-190142 | A | 7/1997 |
| JP | 10-274908 | A | 10/1998 |

* cited by examiner

PROCESSING CARTRIDGE ROTATING A DRUM SHAFT IN DIFFERENT DIRECTIONS AND IMAGE FORMING APPARATUS MOUNTING SUCH A CARTRIDGE

FIELD OF THE INVENTION AND RELATED ART

The present invention relates to a process cartridge and an electrostatic image forming apparatus employing a process cartridge.

Generally, as an electrophotographic image forming apparatus which forms an image on recording medium by carrying out an electrophotographic image formation process, an electrophotographic copying machine, an electrophotographic printer such as a laser beam printer and an LED printer, a facsimileing apparatus, and a wordprocessor, etc., are included. A process cartridge is a cartridge in which an electrophotographic photosensitive drum, and one or more processing means which act on the electrophotographic photosensitive drum, are integrally disposed, and which is rendered removably mountable in the main assembly of an image forming apparatus. Here, a processing means refers to one of a charging means, a developing means, and a cleaning means.

There have been known process cartridges equipped with a residual life informing (warning) means for informing a user of the residual life of a process cartridge to prompt a user to replace the process cartridge. There is a residual life informing means which detects whether or not the residual amount of the developer in a developing means container as a developing means has fallen below a preset value, and informs a user of the result of the detection. There is also a residual life informing means which informs a user that the life of a process cartridge has neared the end of its life due to the wear of the electrophotographic photosensitive drum and/or one of the processing means, for example, the developing means.

As a residual life detecting means which detects the presence (or absence) of developer, a sensor has been known, which detects the presence (or absence) of developer by detecting whether or not a beam of light projected into a developer container is blocked by the developer therein. As a means for detecting the residual life of an electrophotographic photosensitive drum or the like, a system has been widely known, which stores information regarding the cumulatively length of time a photosensitive drum is rotated, the number of prints yielded, etc., in the storage means in a process cartridge, so that the control portion of an image forming apparatus is enabled to determine the state of wear of the photosensitive drum by reading the information stored in the storage means. There is also a system, disclosed in Japanese Laid-open Patent Application 9-190142. In the case of this system, the cumulative length of time one of the components of a process cartridge, which rubs against another component, has been used is stored in the storage means in the process cartridge, and the length of the residual life of the process cartridge is determined based on this information stored in the storage means. There has been also known a system, which detects the length of the residual life of a process cartridge with the use of one of the above described detecting means, and then, displays the detected length of the residual life of the process cartridge on the screen of the displaying means of the main assembly of an image forming apparatus to inform a user of the expiration of the life of the process cartridge. Pertaining to this system, there is the system disclosed in Japanese Laid-open Patent Application 10-274908. In the case of this system, the residual length of the life of an electrophotographic photosensitive drum, the presence (or absence) of developer in a developing means container, the amount of the recovered developer in a cleaning means container, are continuously monitored, and the obtained information is displayed on the monitor of an image forming apparatus to inform a user thereof.

Incidentally, in order to allow a user to quickly determine the residual length of the life of a process cartridge so that the user can quickly deal with what is necessary to be done, the process cartridge itself should be provided with a means which allows the user to visually confirm the expiration of the life of the cartridge. A process cartridge having a displaying means for this purpose is disclosed in Japanese Laid-open Patent Application 57-163276.

SUMMARY OF THE INVENTION

The primary object of the present invention is to provide a process cartridge and an electrophotographic image forming apparatus, which enable a user to visually recognize that the process cartridge has been used at least once for image formation.

Another object of the present invention is to provide a process cartridge and an electrophotographic image forming apparatus, which are simple in structure, and enables a user to visually recognize that the process cartridge has been used at least once for image formation.

Another object of the present invention is to provide a process cartridge and an electrophotographic image forming apparatus, which are small in the space they occupy, and enables a user to visually recognize that the process cartridge has been used at least once for image formation.

Another object of the present invention is to provide a process cartridge and an electrophotographic image forming apparatus, which reversely rotate the drum shaft thereof to enable a user to visually recognize that the process cartridge has been used at least once for image formation.

According to an aspect of the present invention, there is provided a process cartridge detachably mountable to a main assembly of an electrophotographic image forming apparatus for forming an image on a recording material, said process cartridge comprising an electrophotographic photosensitive drum; a drum shaft for being rotated by a driving force supplied from the main assembly of the apparatus and for transmitting a rotating force to said electrophotographic photosensitive drum; and a notification member, movably provided on said drum shaft, for notifying, when said process cartridge is mounted to said main assembly of the apparatus, that process cartridge has reached at least a state that process cartridge has been used for image formation, wherein when said main assembly of the apparatus detects that process cartridge has reached the state, said drum shaft is rotated in a direction opposite to a rotational direction for the image formation to make the notification.

According to another aspect of the present invention, there is provided an electrophotographic image forming apparatus for forming an image on a recording material, wherein a process cartridge is detachably mountable thereto, said apparatus comprising (i) a motor; (ii) control means for controlling a rotational direction of a motor on the basis of detection of a state of said process cartridge; (iii) mounting means for detachably mounting said process cartridge, said process cartridge including, an electrophotographic photosensitive drum, a drum shaft for being rotated by a driving force supplied from the main assembly of the apparatus and for transmitting a rotating force to said electrophotographic photosensitive drum, and a notification member, movably provided on said drum shaft, for notifying, when said process cartridge is mounted to said main assembly of the apparatus, that process cartridge has reached at least a state that process cartridge has been used for image formation, wherein when said control means detects that process cartridge has reached the state, said drum shaft is rotated in a direction opposite to a rotational direction for the image formation to make the notification; and feeding means for feeding the recording material.

These and other objects, features, and advantages of the present invention will become more apparent upon consideration of the following description of the preferred embodiments of the present invention, taken in conjunction with the accompanying drawings.

DETAILED DESCRIPTION OF THE PREFERRED EMBODIMENTS

Hereinafter, the process cartridge and electrophotographic image forming apparatus in each of the preferred embodiments of the present invention will be described in detail with reference to the appended drawings.

Embodiment 1

Figure 1:
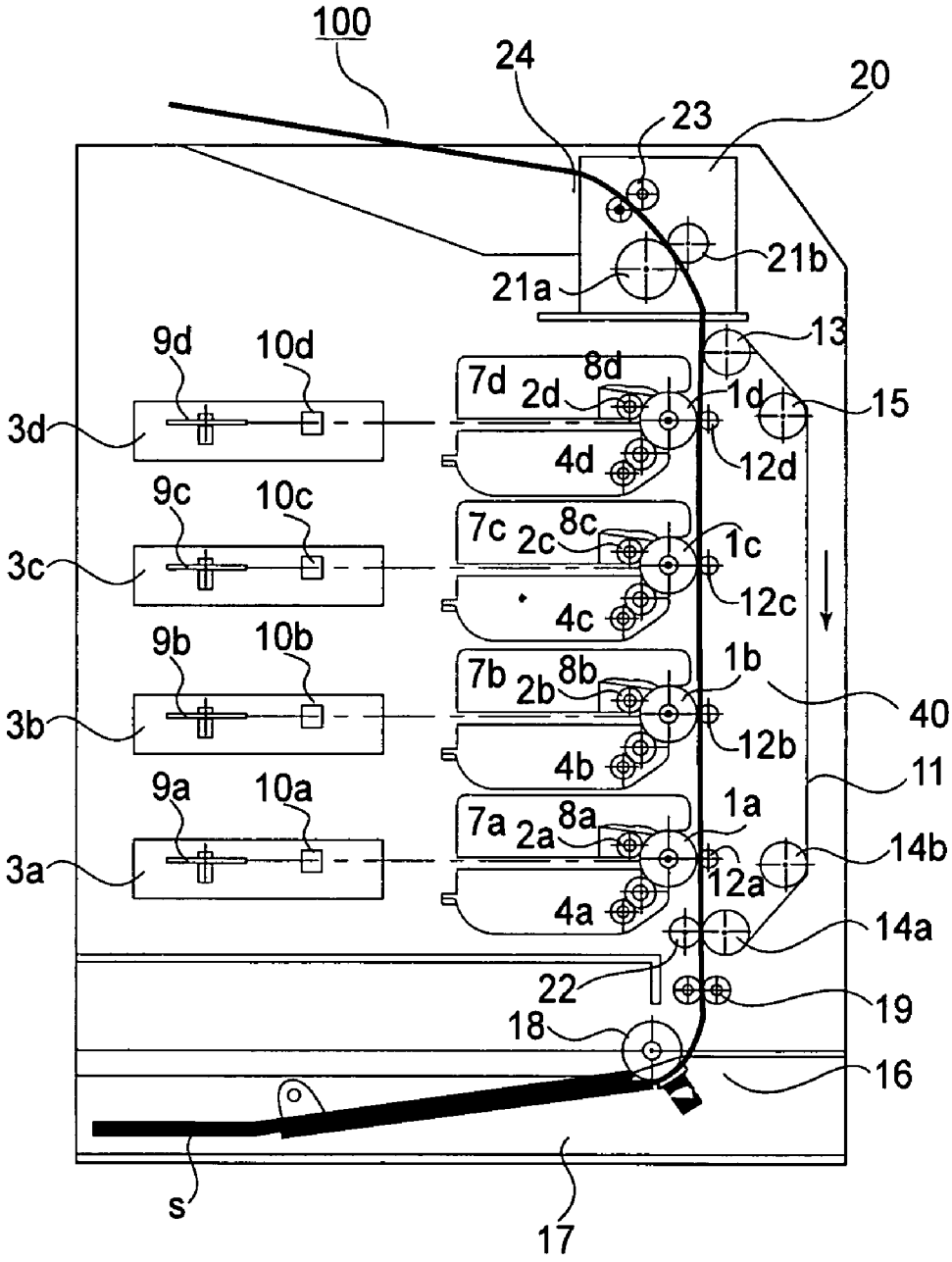
FIG. 1 is a vertical sectional view of the main assembly of the electrophotographic image forming apparatus in the first embodiment of the present invention.
Figure 2:
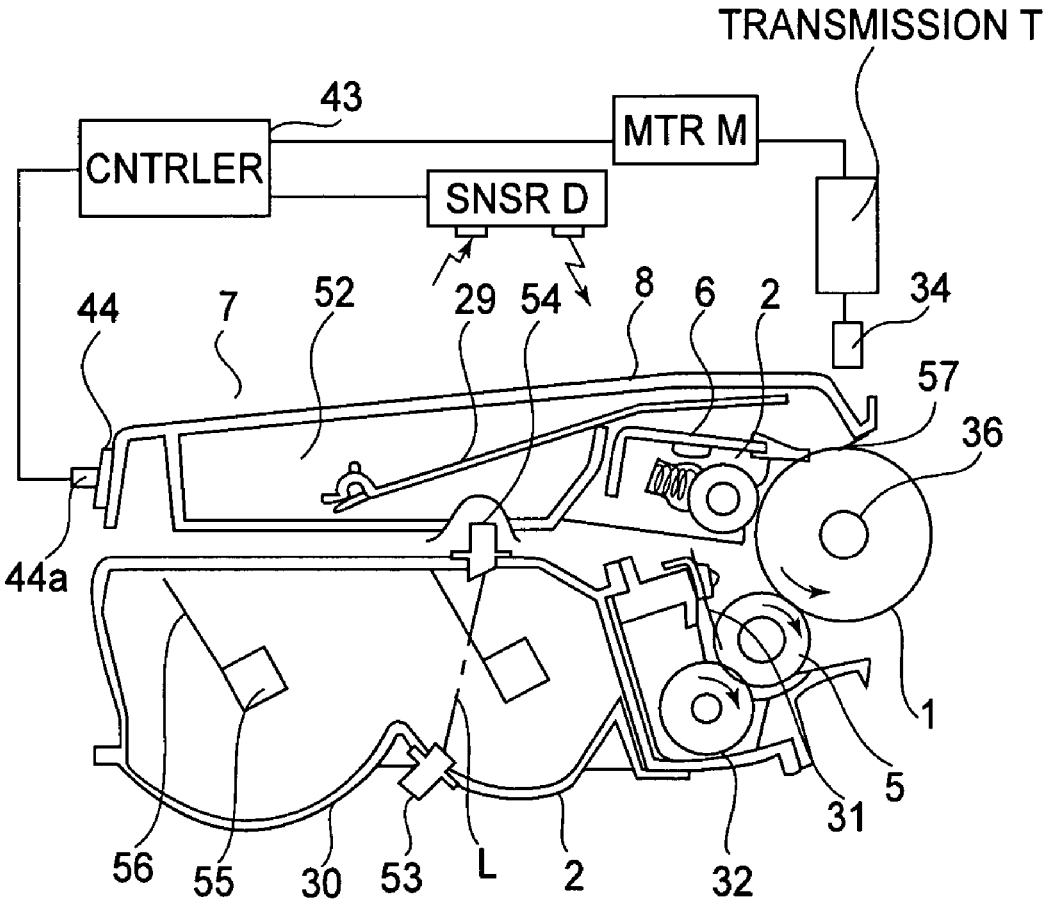
FIG. 2 is a vertical sectional view of the process cartridge in the first embodiment of the present invention.

FIG. 1 shows the main assembly 100 of the multicolor image forming apparatus in this embodiment. This main assembly 100 is structured so that one or more process cartridges 7 (which hereinafter may be referred to simply as cartridge) are removably mountable. In this embodiment, cartridges 7*a*-7*d* having yellow (Y), magenta (M), cyan (C), and black (K) developers, respectively, are mounted in the main assembly, being vertically stacked. Each cartridge has an electrophotographic photosensitive drum (which hereinafter will be referred to as photosensitive drum) 1 (1*a*-1*d*), a charging means 2 (2*a*-2*d*) as a processing means, a development unit 4 (4*a*-4*d*), and a cleaning unit 8 (8*a*-8*d*). FIG. 2 shows one of these cartridges 7.

Referring to FIG. 2, the photosensitive drum 1 rotates around a drum shaft 36 in the counterclockwise direction, as the positive direction, indicated by an arrow mark in the drawing, by receiving rotational driving force from a motor M through a driving force transmitting means and a coupling 34. This positive direction is the direction in which the photosensitive drum 1 rotates for image formation. The photosensitive drum 1 is made up of an aluminum cylinder, which is 30 mm, for example, in diameter, and a layer of organic photoconductive substance coated on the peripheral surface of the aluminum cylinder. It is rotatably supported at the lengthwise ends by a shaft, with a supporting member disposed between the lengthwise ends and the shaft. The supporting member will be described later.

As the charging means 2, a charging means of the contact type capable of uniformly charging the peripheral surface of the photosensitive drum 1 may be employed. The charging member of the charging means in this embodiment is in the form of a roller, more specifically, an electrically conductive charge roller, which is placed in contact with the peripheral surface of the photosensitive drum 1, and to which charge bias voltage is applied. As the charge bias voltage is applied to the charge roller, the charging means 2 uniformly charges the peripheral surface of the photosensitive drum 1.

The development unit 4 adheres developer to an electrostatic latent image to develop the latent image into an image formed of the developer. It is made up of a development roller 5 as a developer bearing member, and a developing means container, with which the rotational axle of the development roller 5 is rotatably supported roughly in parallel to the drum shaft 36 of the photosensitive drum 1. The developer stored in the developing means container is supplied to the photosensitive drum 1 by the development roller 5, to form an image of the developer, on the peripheral surface of the photosensitive drum 1. The development unit 4 also has a developing means container 30 in which the developer is stored, a development blade 31 which regulates the amount by which the developer is allowed to be uniformly borne on the development roller 5, a developer supply roller 32, and a stirring member 55 for stirring the developer. In the development unit 4, the developer is conveyed from the developing means container 30 to the developer supply roller 32 by the stirring member 55, and then, is supplied to the development roller 5 by the developer supply roller 32. As the development roller 5 is rotated in the clockwise direction, the developer is borne on the peripheral surface of the development roller 5. As the development roller 5 is further rotated, the layer of developer borne on the peripheral surface of the development roller 5 is regulated in thickness, while being given electric charge, by the development blade 31 kept pressed upon the peripheral surface of the development roller 5. As a result, the peripheral surface of the development roller 5 is coated with a thin layer of the electrically charged developer, which is uniform in thickness. The stirring member 55 is made up of a shaft, which is rotatably supported by the developing means container 30, and a stirring blade 56 formed of an elastic sheet. It rotates in the counterclockwise direction.

The abovementioned developing means container 30 is provided with a light entrance window through which a beam of light is projected into the container 30 to detect the residual amount of the developer in the container 30, and a light exit window through which the beam of light possibly exits. The light entrance window 53 and light exit window 54 are covered with an window pane formed of transparent resinous substance, allowing a beam of developer detection light L emitted from the light emitting element of a sensor D with which the image forming apparatus is provided, to enter the developing means container 30. The two windows 53 and 54 are positioned so that it is possible for the developer detection light L having entered the developing means container 30 through the entrance window 53 to reach the exit window 54 to be received by the light detecting portion of the sensor D.

Thus, when there is a substantial amount of developer in the developing means container 30, the developer blocks the developer detection light L, and therefore, the developer detection light L is not detected by the light detecting portion of the sensor D. On the other hand, as the developing means container 30 is depleted of the developer therein due to the developer consumption, it becomes possible for the developer detection light L to traverse the internal space of the developing means container 30 to be detected by the light detecting portion of the sensor D.

To the cleaning unit 8, the photosensitive drum 1 is attached; the drum shaft which rotatably supports the photosensitive drum 1 is attached to the cleaning unit 8. The main assembly 100 is provided with an electrostatic transferring apparatus, which transfers a developer image (image formed of developer) on the photosensitive drum 1, onto a transfer sheet S as recording medium. The cleaning unit 8 removes the transfer residual toner, that is, the toner remaining on the peripheral surface of the photosensitive drum 1 after the image transfer. The cleaning unit 8 is provided with a cleaning blade 6, which is kept in contact with the photosensitive drum 1 to remove the developer remaining on the drum, and includes a charge roller 2 for uniformly charging the peripheral surface of the photosensitive drum 1. In the cleaning means container 50 of the cleaning unit 8, a conveying means 29 is disposed, which conveys the removed developer to a developer storing portion 52. The cleaning unit 8 is also provided with a flexible member 57 (formed of 30 μm-100 μm thick polyethylene terephthalate sheet), which is attached to the cleaning unit 8 with the use of two-sided adhesive tape or the like, so that it is placed in contact with the peripheral surface of the photosensitive drum 1. The flexible member 57 is tilted so that its tip is positioned on the downstream side of its base, in terms of the rotational direction of the photosensitive drum 1. The aforementioned cleaning blade 6 is positioned on the downstream side of the flexible member 57 in terms of the positive direction (normal direction) of the photosensitive drum rotation. It is placed in contact with the peripheral surface of the photosensitive drum 1 so that its tip is on the downstream side of its base in terms of the positive direction of the photosensitive drum rotation. Thus, the residual developer, that is, the developer remaining on the peripheral surface of the photosensitive drum 1 even after the image transfer, is scraped away from the peripheral surface of the photosensitive drum 1, and is stored in the cleaning unit 8. As the portion of the peripheral surface of the photosensitive drum 1, which was covered with the residual developer, is cleared of the developer, it becomes ready for the next image formation process.

Also to the cleaning unit 8, a nonvolatile storage means 44 such as an EEPROM or the like is attached. The storage means 44 is connected, in electrical terms, to the image forming apparatus main assembly 100 by a connector 44*a*, as shown in FIG. 2, making it possible for information to be exchanged between the storage means 44 and the control portion 43 of the apparatus main assembly 100. In other words, the information in the storage means 44 is readable by the control portion 43, and also, information is writable in the storage means 44 by the control portion 43. As the storage means 44, a memory of the noncontact type, which is capable of sending or receiving signals without being directly connected (being electromagnetically connected) to the component with which it communicate, may be employed. As for the contents to be continuously written by the control portion 43 into the storage means 44 and stored therein, there is the information indicating the amount of the wear of the consumables, for example, the cumulative length of time the photosensitive drum 1 and/or the development roller 5 has been rotated, in addition to the information regarding the cumulative count of the prints yielded by the image forming apparatus and the information regarding the cartridge in the brand-new condition. Whether or not a process cartridge 7 (which hereinafter may be referred to simply as cartridge) has reached the end of its life is determined based on the information written in the storage means 44.

Figure 3:
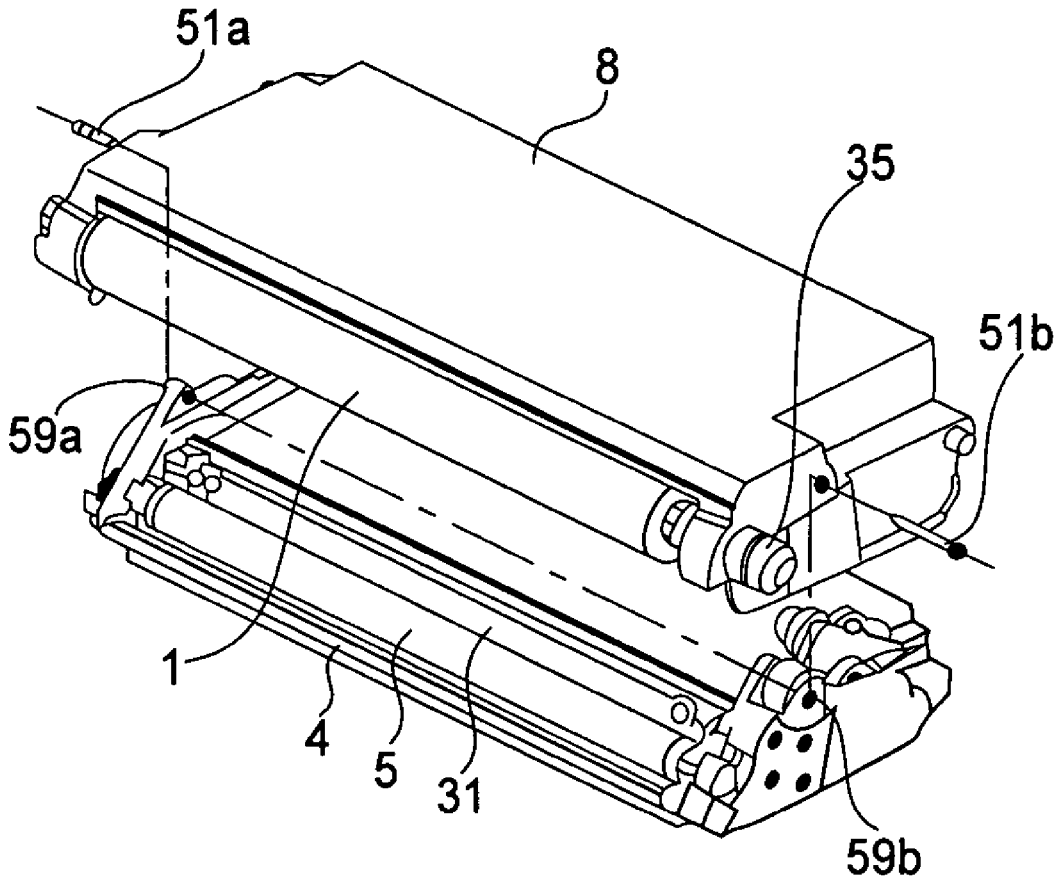
FIG. 3 is a drawing showing how the cleaning unit and developing unit are joined with each other.
Figure 4:
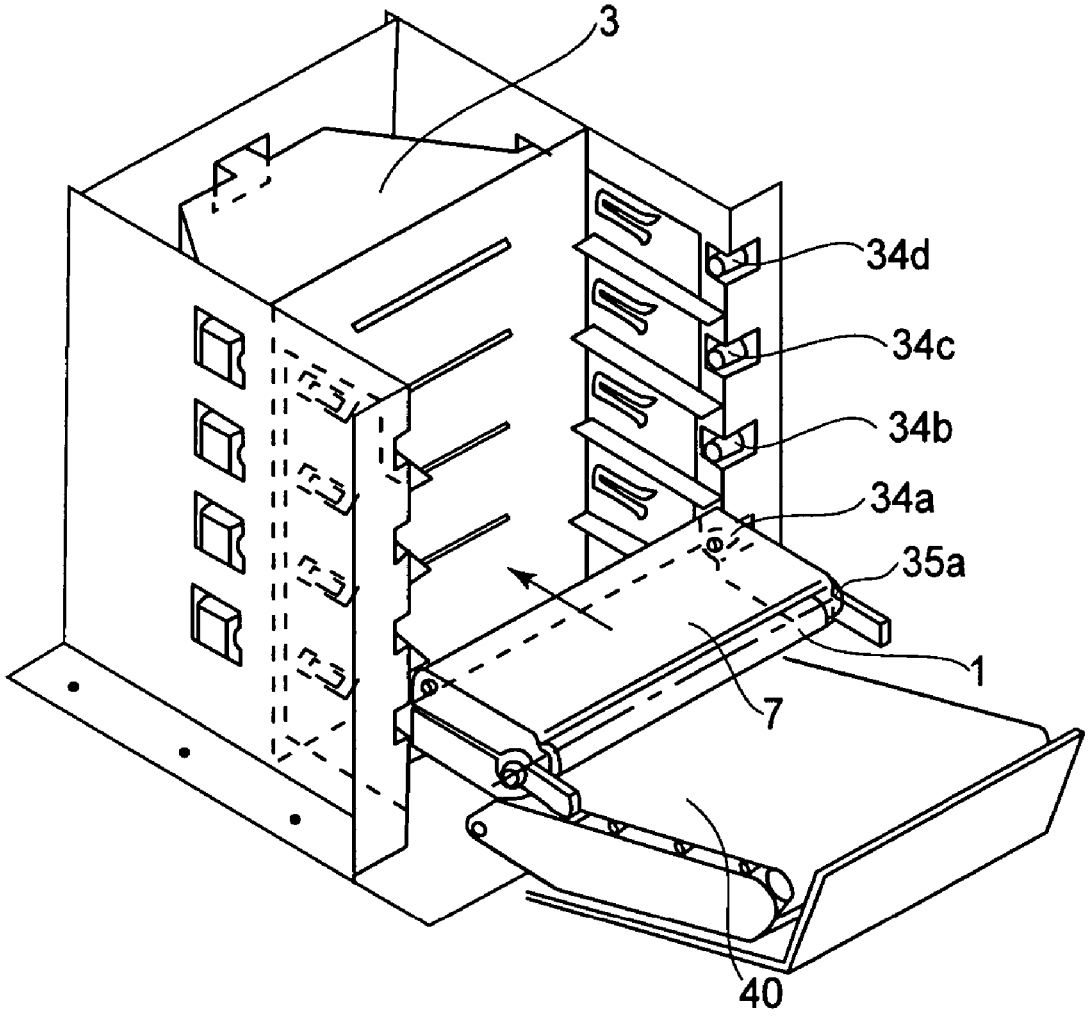
FIG. 4 is a perspective view of the main assembly of the electrophotographic image forming apparatus, and process cartridge, in the first embodiment of the present invention, showing how the process cartridge is mounted into the main assembly.
Figure 5:
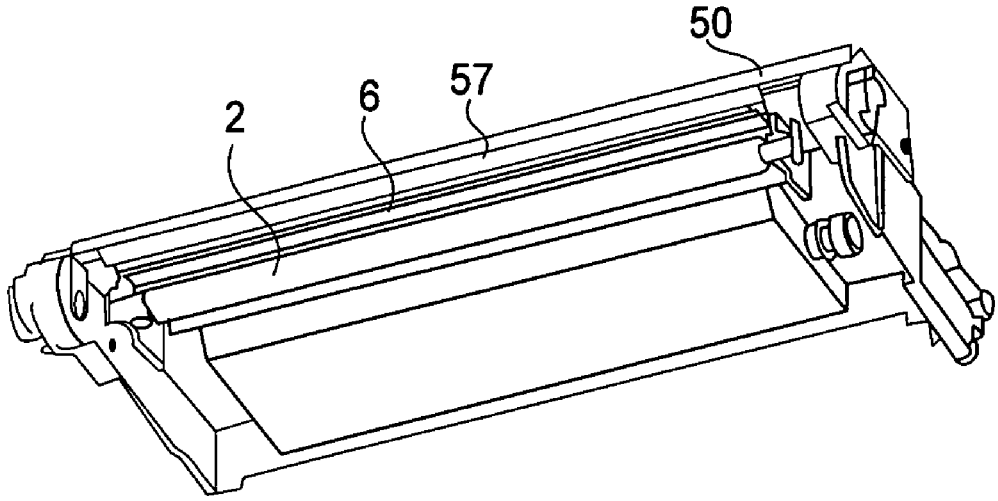
FIG. 5 is a perspective view of the cleaning means container in the first embodiment of the present invention.
Figure 6:
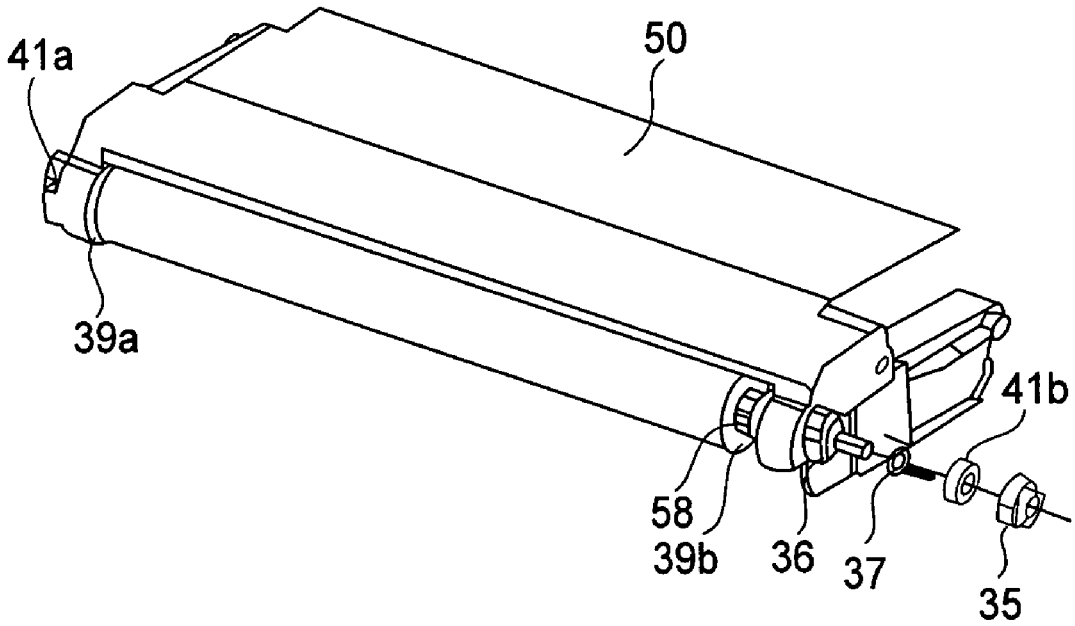
FIG. 6 is a perspective view of the process cartridge, and its spring, in the first embodiment of the present invention, showing how the spring is attached.

FIG. 3 shows how the development unit 4 and cleaning unit 8 are joined when assembling the cartridge 7. First, connection pins 51*a* and 51*b* are to be inserted into the cleaning unit 8 so that they fit into the holes 59*a* and 59*b*, respectively, the axial line of which coincide with the axis about which the development unit 4 pivots. As a result, the development unit 4 and the cleaning unit 8 become connected so that they are allowed to pivot about the connection pins 51*a* and 51*b*. FIG. 4 shows how a driving coupling 34 (34*a*-34*d*) becomes connected with a drum coupling 35*a* (attached to one of the lengthwise ends of the photosensitive drum 1) to transmit driving force from the main assembly 100 of the image forming apparatus to the photosensitive drum 1.

Referring again to FIG. 1, the apparatus main assembly 100 is provided with an electrostatic transfer belt 11, which is disposed so that it circularly moves in contact with the photosensitive drums 1*a*-1*d*. The electrostatic transfer belt 11 is formed of film. It is suspended by four rollers so that the loop it forms vertically extends. The electrostatic transfer belt 11 is circularly moved so that the transfer sheet S is electrostatically adhered to the outward surface of the electrostatic transfer belt 11, at the left end (in FIG. 1), and is placed in contact with the photosensitive drums 1. Thus, as the electrostatic transfer belt 11 is circularly moved, the transfer sheet S is conveyed by the electrostatic transfer belt 11 to each of the transfer positions, at which the developer image on each photosensitive drum 1 is transferred onto the transfer sheet S. Further, the apparatus main assembly 11 is provided with transfer rollers 12 (12*a*, 12*b*, 12*c*, and 12*d*), which are positioned so that they contact the inward surface of the electrostatic transfer belt 11 and oppose the photosensitive drums 1*a*, 1*b*, 1*c*, and 1*d*. From each transfer roller 12, positive electric charge is applied to the transfer sheet S as recording medium, through the electrostatic transfer belt 11. As a result, the developer image on the photosensitive drum 1, which is negative in polarity, is transferred by the electric field generated by this positive electric charge, onto the transfer sheet S which is in contact with the photosensitive drum 1. The electrostatic transfer belt 11 is stretched around four rollers, namely, a driver roller 13, follower rollers 14*a* and 14*b*, and a tension roller 15, and rotates in the clockwise direction, which is the normal direction, indicated by an arrow mark in FIG. 1. With the provision of this structural arrangement, as the electrostatic transfer belt 11 circularly moves, the transfer sheet S is moved from the follower roller 14*a* side to the driver roller 13 side, and as the transfer sheet S is conveyed, the developer images are transferred onto the transfer sheet S.

Also referring to FIG. 1, the scanner unit 3 is an exposing means for forming an electrostatic latent image on the photosensitive drum 1, by projecting a beam of laser light while modulating it with image formation data. It is disposed roughly level with the photosensitive drum 1. This scanner unit 3 is structured so that a beam of image formation light emitted by a laser diode in response to video signals is projected onto a polygon mirror 9 (9*a*-9*d*) which is being rotated at a high speed by a scanner motor (unshown). The beam of image formation light deflected by the polygon mirror selectively exposes, through a focusing lens 10 (10*a*-10*d*), the numerous points of the charged surface of the photosensitive drum 1. As a result, an electrostatic latent image is formed.

Referring again to FIG. 1, a paper feeding portion 16 feeds the transfer sheet S as recording medium into the main assembly 100 of the image forming apparatus, and then, conveys it to the portion of the above described electrostatic transfer belt 11, which is in the image forming portion. In a paper feeder cassette 17, multiple transfer sheets S are stored. During an image forming operation, a paper feeding roller 18 is driven in response to the image forming operation, feeding the transfer sheets S in the paper feeder cassette 17, into the main assembly 100 while separating the transfer sheets S one by one, and conveys them further into the main assembly 100. As the leading edge of each transfer sheet S hits a pair of registration rollers 19, it is temporarily held up. Then, it is released by the registration rollers 19 in synchronism with the rotation of the above described electrostatic transfer belt 11 and the rotation of the photosensitive drum 1, so that it is allowed to be delivered to the electrostatic transfer belt 11.

A fixing portion 20 is the portion that fixes the multiple developer images, different in color, having transferred onto the transfer sheet S. It is made up of a rotatable heat roller 21*a*, and a pressure roller 21*b* which is pressed upon the heat roller 21*a* to apply heat and pressure to the multiple developer images on the transfer sheet S. After the transfer of the developer images on the photosensitive drums 1 onto the transfer sheet S, the transfer sheet S is conveyed through the fixing portion 20 by the heat roller 21*a* and pressure roller 21*b*. While the transfer sheet S is conveyed through the fixing portion 20, it is given heat and pressure by the two rollers 21*a* and 21*b*. As a result, the multiple developer images different in color are fixed to the surface of the transfer sheet S.

With the image forming apparatus structured as described above, when it forms an image, it operates as follows.

The four different cartridges 7*a*-7*d* are sequentially driven in synchronism with printing timing. As they are driven, the photosensitive drums 1*a*-1*d* rotate in the counterclockwise direction. Next, the scanner units 3*a*-3*d*, which correspond to cartridges 7*a*-7*d*, respectively, are sequentially driven. Also as the photosensitive drums 1*a*-1*d* are driven, the charge roller of each of the charging means 3 uniformly charges the peripheral surface of the corresponding photosensitive drum 1. The scanner unit 3 exposes the peripheral surface of the photosensitive drum 1 in response to video signals (image formation signals), forming thereby an electrostatic latent image on the peripheral surface of the photosensitive drum 1. The development roller 5 in the development unit 4 forms a developer image on the peripheral surface of the photosensitive drum 1 by transferring developer onto the points of the electrostatic latent image, which are low in potential.

Next, the transfer sheet S is pinched by an electrostatic adhesion roller 22 and the electrostatic transfer belt 11, being thereby pressed upon the outward surface (in terms of loop formed by electrostatic transfer belt 11) of the electrostatic transfer belt 11, and voltage is applied between the electrostatic transfer belt 11 and electrostatic adhesion belt 22, inducing thereby electric charge in the transfer sheet S, which is dielectric, and the dielectric layer of the electrostatic transfer belt 11. As a result, the transfer sheet S is electrostatically adhered to the outward surface of the electrostatic transfer belt 11. With the employment of the above described structural arrangement, the transfer sheet S is kept reliably adhered to the electrostatic transfer belt 11, and conveyed, while remaining adhered to the belt 11, to the transfer portion, which is located at the most downstream portion of the electrostatic transfer belt 11.

While the transfer sheet S is conveyed in the above described manner, the developer images on the photosensitive drums 1*a*-1*d* are sequentially transferred onto the transfer sheet S by the electric fields formed between the photosensitive drums 1*a*-1*d* and transfer rollers 12*a*-12*d*, respectively. After the transfer of the four developer images different in color onto the transfer sheet S, the transfer sheet S is separated utilizing the curvature of the belt driver roller 13, and is conveyed into the fixing portion 20. In the fixing portion 20, the abovementioned developer images are thermally fixed to the transfer sheet S. Then, the transfer sheet S is discharged from the apparatus main assembly 100 by a pair of discharge rollers 23, through a paper discharging portion 24, with the image bearing surface of the transfer sheet S facing downward.

(Process Cartridge Life Informing Member)

As the amount of the developer in the developing means container falls below a preset value due to the repetition of the developer image formation on the transfer sheet S, it is detected by a means for detecting the residual cartridge life (which hereinafter will be referred to simply as cartridge life detecting means). Based on this detection, the control portion 43 of the image forming apparatus main assembly 100 determines that the process cartridge 7 has reached the end of its life. Then, it informs a user of this fact, and prompts the user to replace the cartridge, replenish the developing means container with developer, or perform the like operation. Hereafter, the structure and operation of the cartridge life detecting means will be described.

Immediately before the photosensitive drum 1 is attached to the cleaning means container 50, the cleaning blade 6, charge roller 2, etc., are attached to the cleaning means container 50. Referring to FIGS. 5-8, as for the structure for supporting the photosensitive drum 1, a photosensitive drum unit 38 is completed by fitting a pair of flanges 39*a* and 39*b* into the lengthwise ends of the photosensitive drum 1, one for one; the structure for supporting the drum unit 38 is realized. Then, after a drum shaft 36 is put through the flanges 39 of the photosensitive drum unit 38, a pin 58 is pressed into the drum shaft 36 through the flange 39*b*.

Figure 7:
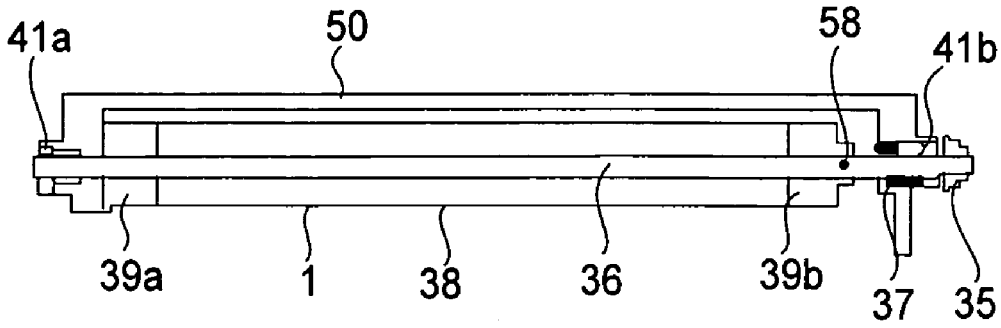
FIG. 7 is a sectional view of the drum supporting member in the first embodiment of the present invention.

Further, to the drum shaft 36, a spring 37 (elastic member) is attached. As for the method for attaching the spring 37 to the drum shaft 36, the spring 37 is fitted around the drum shaft 36. Thereafter, the drum bearings for rotatably supporting the drum shaft 36 by the cleaning means container 50 are attached, and then, a drum coupling 35 by which driving force is received from the apparatus main assembly 100 to drive the photosensitive drum 1 is attached. The drum coupling 35 and drum shaft 36 are connected by pressing a pin (unshown) into them. FIG. 7 is a sectional view of the cleaning unit 8 after the components to be attached to the drum shaft 36 have all been attached to the drum shaft 36, and the photosensitive drum 1 has been rotatably attached to the cleaning means container 50.

Figure 9:
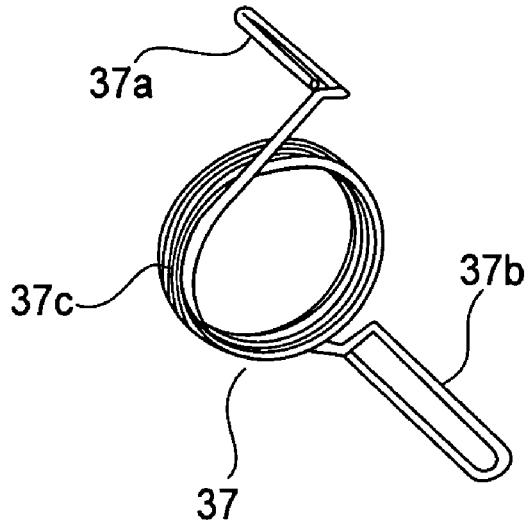
FIG. 9 is a perspective view of the informing member in the first embodiment of the present invention.
Figure 10:
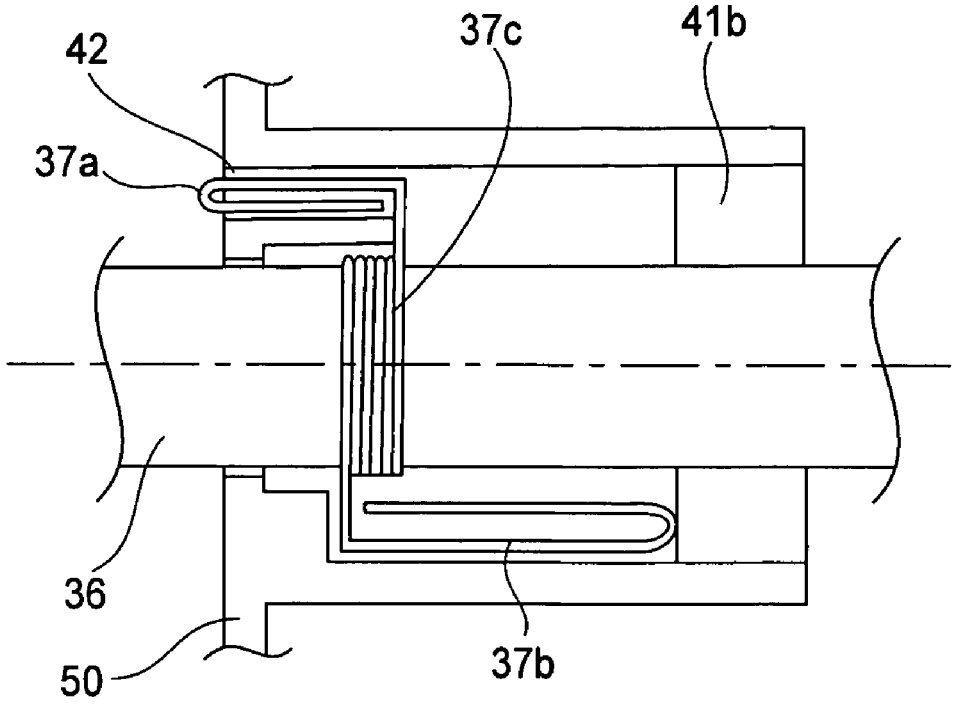
FIG. 10 is a sectional view of the informing means in the first embodiment of the present invention.

Referring to FIG. 9, the spring 37 is made up of a coiled portion 37*c*, and end portions extending from the ends of the coiled portion 37*c*. Each of the end portions is bent in a specific shape. FIG. 10 is a sectional view of the spring 37 attached to the cleaning unit 8. The internal diameter of the coiled portion 37*c* of the spring 37 is roughly 0.2 mm smaller than the external diameter of the drum shaft 36. Thus, as it is fitted around the drum shaft 36, it generates in itself such a force that causes it to tighten around the drum shaft 36. In other words, the spring 37 does not require a component dedicated to attaching the spring 37 to the drum shaft 36; the coil spring keeps itself attached to the peripheral surface of the drum shaft by the force generated by its coiled portion 37*c* in the direction to cause the coiled portion 37*c* to tighten around the drum shaft 36. The end portions extending from the ends of the coiled portion 37*c* make up an indicator portion 37*a* (one of end portions) and a positioning portion 37*b* (other end portion).

The indicator portion 37*a* is exposed from the cleaning means container 50; it protrudes roughly 1 mm from the cleaning means container 50 through a hole 42 of the cleaning means container 50, being therefore visible by a user. The positioning portion 37*b* controls the position of the spring 37, in terms of the lengthwise direction of the process cartridge 7, by being sandwiched by the cleaning means container 50 and a drum bearing 41*b*. With the provision of this structural arrangement, the distance by which the indicator portion 37*a* protrudes outward from the cleaning means container 50 is kept constant.

Being structured as described above, the cartridge life indicating portion moves as will be described next.

Figure 8:
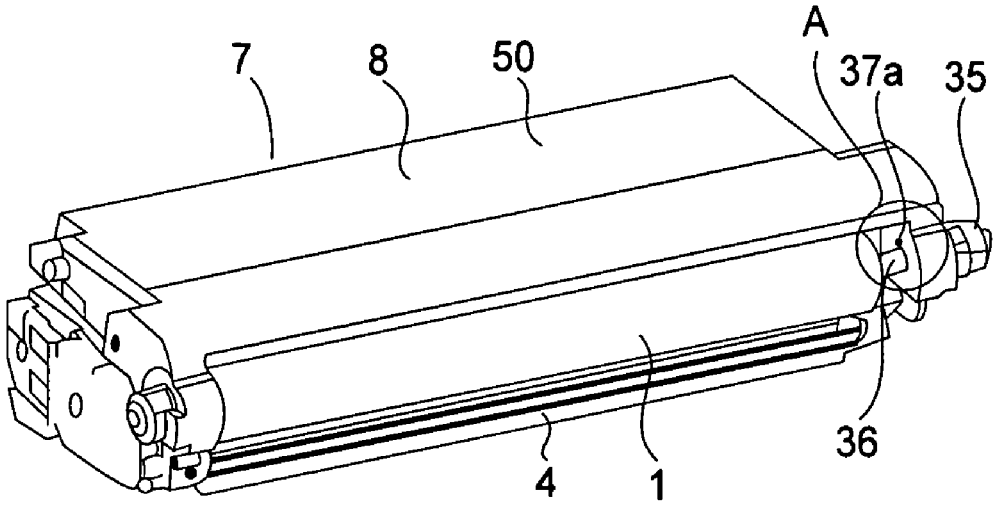
FIG. 8 is a perspective view of the process cartridge in the first embodiment of the present invention.
Figure 11:
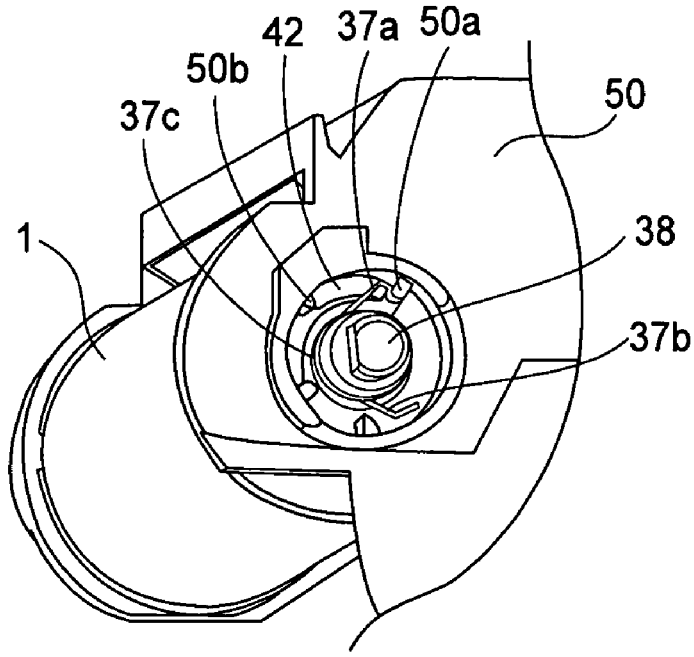
FIG. 11 is a perspective view of the process cartridge in the first embodiment of the present invention.
Figure 12:
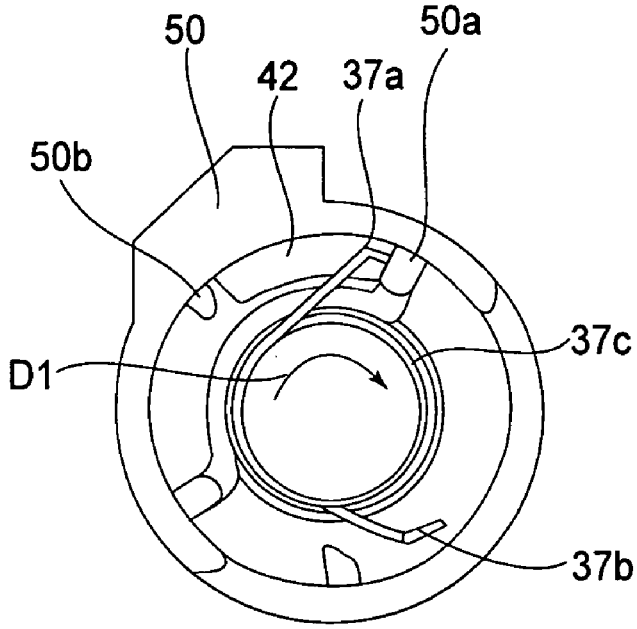
FIG. 12 is a drawing of the informing member in the first embodiment of the present invention.
Figure 13:
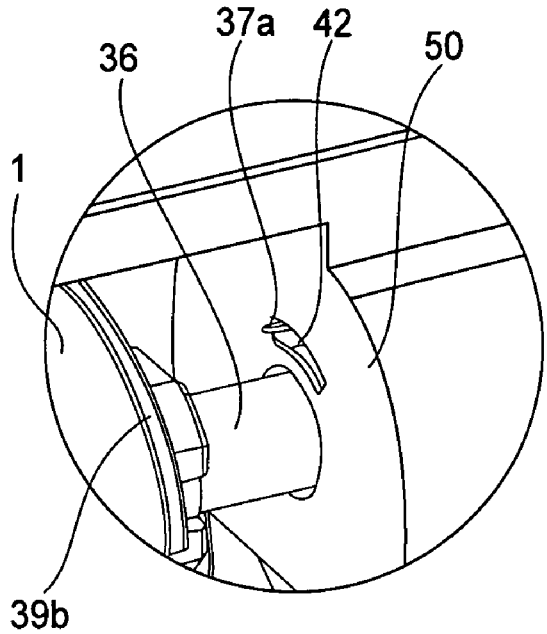
FIG. 13 is a perspective drawing of the informing member in the first embodiment of the present invention.

FIGS. 10 and 11 show the movements of the spring 37, which occur as the photosensitive drum 1 is rotated in the positive direction. FIG. 11 shows the state of the spring 37 attached to the drum shaft 36, although the drum coupling 35 and drum bearing 41 have been intentionally omitted from the drawing to show the positioning of the spring 37. FIG. 10 shows the position of the spring 37 after the photosensitive drum 1 has been rotated in the positive direction by the driving force it received from the image forming apparatus main assembly. As the photosensitive drum 1 is rotated, the spring 37 is subjected to the force which acts in the direction to rotate the spring 37 in the same direction as the rotational direction (direction indicated by arrow mark D1 in drawing) of the photosensitive drum 1, because of the presence of the friction generated between the drum shaft 36 and the coiled portion 37*c* of the spring 37 by the force acting in the coiled portion 37*c* in the direction to cause the coiled portion 37*c* to tighten around the drum shaft 36. As a result, the spring 37 rotates in the same direction as the rotational direction of the photosensitive drum 1. Consequently, the indicator portion 37*a* hits the regulating portion 50*a* of the cleaning means container 50. As the indicator portion 37*a* hits the regulating portion 50*a*, the spring 37 begins to slip on the drum shaft 36, remaining therefore in the position in which it hit the regulating portion 50*a*. In other words, the spring 37 remains in the position (first position) in which one end 37*a* of the spring 37 is protruding through the hole 42 of the cleaning means container 50. This occurs for the following reason. That is, as the indicator portion 37*a* of the spring 37 hits the regulating portion 50*a*, such force that works into the direction to reduce the force acting in the direction to cause the coiled portion 37*c* to tighten around the drum shaft 37 acts on the coiled portion 37*c* through the indicator portion 37*a*, because of the preset direction in which the coiled portion 37*c* had been wound. Referring to FIG. 8, and FIG. 13 which is an enlarged view of the portion of FIG. 8, which is designated by a referential symbol A in FIG. 8, the cartridge life informing portion is structured so that while the photosensitive drum 1 is rotated in the positive direction, the indicator portion 37*a* of the spring 37 is visible to a user through a cartridge life indicating portion A of the cleaning means container 50. As described above, before the spring 37 is attached to the drum shaft 36, the internal diameter of the coiled portion 37*c* of the spring 37 is smaller than the external diameter of the drum shaft 36. Therefore, when attaching the spring 37 to the drum shaft 36, the spring 37 is to be fitted around the drum shaft 36 while keeping the internal diameter of the coiled portion 37*c* rendered greater than the external diameter of the drum shaft 36, that is, expanding the coiled portion 37*c* in the radius direction thereof, by applying pressure to the spring 37 in the direction opposite to the winding direction of the coiled portion 37*c*. Then, the pressure applied to the spring 37 in the above described opposite direction is to be removed after the fitting of the spring 37 around the drum shaft 36. As the force is removed, the coiled portion 37*c* is allowed to generate therein the force which works in the direction to restore its original internal diameter, that is, the force which works in the direction to cause the coiled portion 37*c* to tighten around the drum shaft 36. In other words, this force which works in the direction to cause the coiled portion 37*c* to tighten around the drum shaft 36 is a static force, which does not contribute to the movement of the drum shaft 36.

This spring 37 has the merit of not adversely affecting the accuracy with which the photosensitive drum 1 is driven. That is, it is only the force generated in the direction to cause the coiled portion 37*c* to tighten around the drum shaft 36 that is used to keep the spring 37 attached to the drum shaft 36. Therefore, the only influence that the spring 37 has on the drum shaft 36 when the photosensitive drum 1 is rotated for image formation is a negative load of a specific amount which is attributable to the friction between the coiled portion 37*c* and the drum shaft 36. Thus, the amount of the load which applies to the drum shaft 36 as the drive shaft of the photosensitive drum 1 does not change, and therefore, it does not adversely affect the accuracy with which the photosensitive drum 1 is driven.

Next, referring to FIGS. 12-17, the movements of the spring 37, which occur as the cartridge 7 reaches the end of its life will be described.

The signals from the sensor D shown in FIG. 2, and/or the information stored in the storage means 44, for example, the information regarding such processing means as the photosensitive drum 1, development roller 5, etc., is inputted into the control portion 43. Based on this information, the control portion 43 determines whether or not the cartridge 7 has reached the end of its life. As the control portion 43 determines that the cartridge 7 has reached the end of its life, it sends to the motor M the signal for instructing the motor to rotate by a preset amount in the direction opposite to the direction in which the motor M rotates for image formation. As a result, the photosensitive drum 1 is rotated in the direction opposite to the direction in which the photosensitive drum 1 is rotated for image formation, by a preset amount, by the driving force transmitted there to from the motor M.

Figure 14:
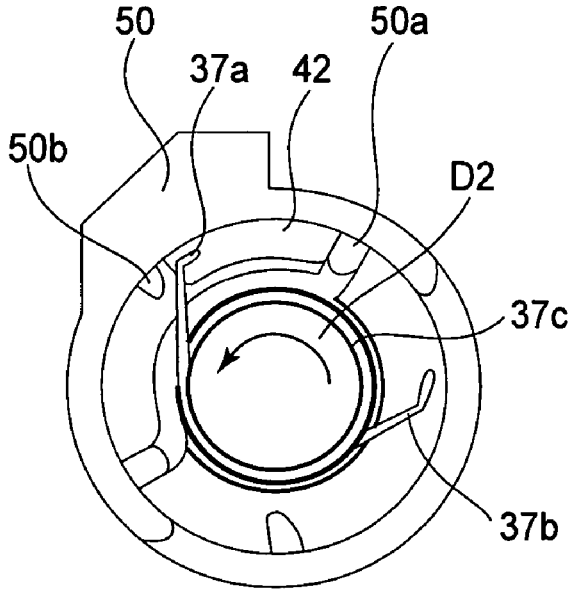
FIG. 14 is a drawing of the informing member in the first embodiment of the present invention.

FIGS. 13 and 14 show the state of the spring 37, which has occurred as the photosensitive drum 1 reversely rotated the preset amount by receiving the driving force from the motor M, whereby the spring 37 was reversely rotated. As the photosensitive drum 1 rotates in the reverse direction, the spring 37 rotates with the drum shaft 36, causing the indicator portion 37*a* to separate from the regulating portion 50*a* and move in the hole 42 in the same direction as the rotational direction (indicated by arrow mark D2 in drawing) of the drum shaft 36. Then, the indicator portion 37*a* moves over the regulating portion 50*b*, reaching a position (second position) shown in FIG. 13. In other words, one end 37*a* of the spring 37 comes out of the hole 42 and enters the cleaning means container 50 as the cleaning means frame. The reason why the indicator portion 37*a* is allowed to move over the regulating portion 50*b* is that the coiled portion 37*c* of the spring 37 was wound in the aforementioned specific direction. That is, the coiled portion 37*c* of the spring 37 was wound so that as the drum shaft 36 rotates in the direction indicated by the arrow mark D2 in FIG. 14, the coiled portion 37*c* reduces in internal diameter. As the coiled portion 37*c* reduces in internal diameter, it increases in the amount of force by which it grips the drum shaft 36. Therefore, even after the indicator portion 37*c* comes into contact with the regulating portion 50*b*, the coiled portion 37*c* does not slip on the drum shaft 36. As a result, the indicator portion 37*c* is caused to move over the first regulating portion 30*b* and enters, and settles in, the cleaning means container 50. In this case, the amount of force by which the coiled portion 37*c* grips the drum shaft 36 equals the amount of the force generated in the coiled portion 37*c* as the coiled portion 37*c* is reduced in internal diameter.

Figure 15:
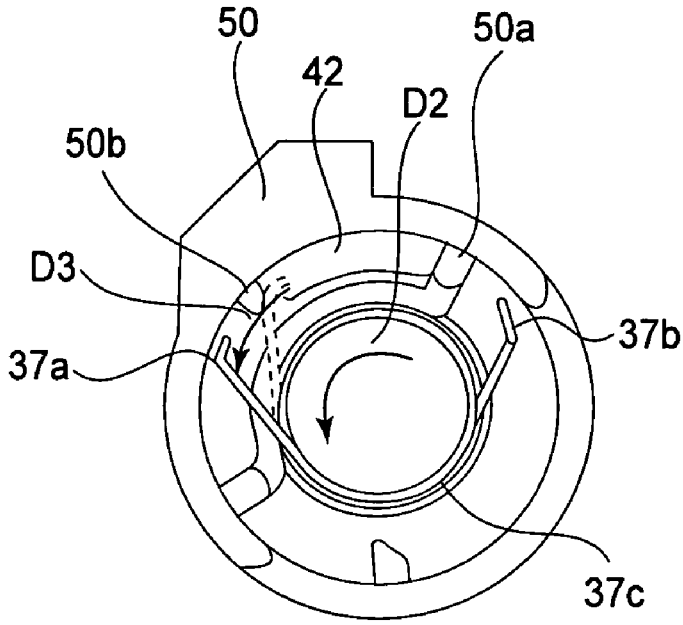
FIG. 15 is a drawing of the informing member in the first embodiment of the present invention.
Figure 16:
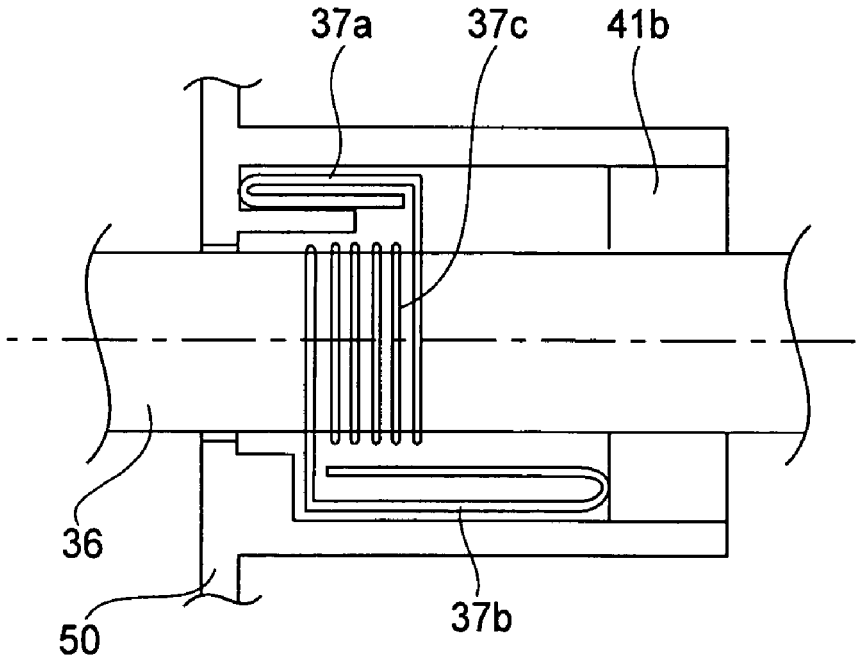
FIG. 16 is a sectional drawing of the informing member in the first embodiment of the present invention.
Figure 17:
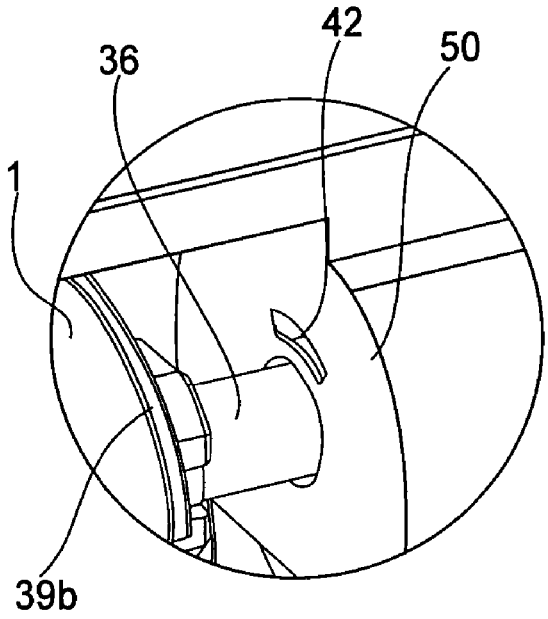
FIG. 17 is a perspective drawing of the informing member in the first embodiment of the present invention.
Figure 18:
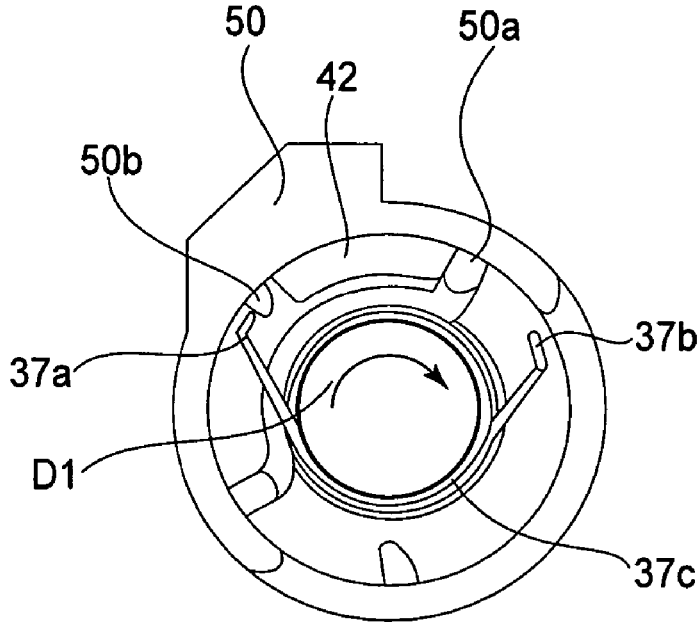
FIG. 18 is a drawing of the informing member in the first embodiment of the present invention.
Figure 19:
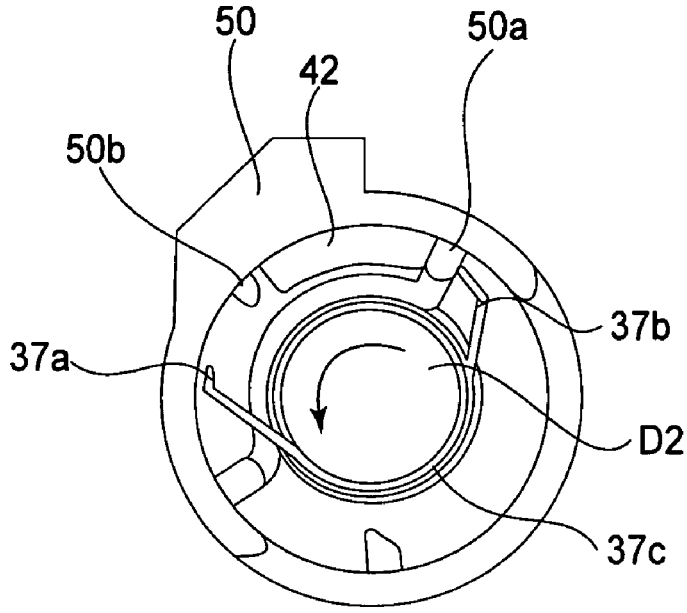
FIG. 19 is a drawing of the informing member in the first embodiment of the present invention.

FIG. 15 is a side view of the spring 37 and its adjacencies, as seen from the direction of the axial line of the photosensitive drum 1, and FIG. 16 is a sectional view of the spring 37 and its adjacencies, at a plane coinciding with the axial line of the photosensitive drum 1. The indicator portion 37*c* of the spring 37 is not exposed through the hole 42; it is hidden in the cleaning means container 50 (it is in second position). It should be noted here that as the spring 37 is rotated in reverse, not only is the indicator portion 37*c* moved in the abovementioned direction, but also, it is moved in the lengthwise direction of the cartridge 7. As a result, the coiled portion 37*c*, which has been tightened, is loosened. Through the above described movements, the state of the indicator portion 37*c* changes from the one shown in FIG. 13 in which it is visible from outside, into the one shown in FIG. 17. Therefore, one glance is enough for a user to recognize that the cartridge has reached the end of its life; the user is prompted to replace the cartridge 7 or replenish the developing means container with developer.

However, there is such a case that even after a user is informed by the spring 37 that the cartridge 7 has reached the end of its life, the user continues to use the cartridge 7. Thus, the indicator portion 37*c* must be enabled to remain in the state in which it indicates the expiration of the cartridge life. That is, the cartridge 7 and its cartridge life indicating portion must be structured so that once the spring 37 is rotated into the position in which it indicates that the cartridge 7 has reached the end of its life, the indicator portion 37*a* of the spring 37 remains hidden in the cleaning means container 50, regardless of whether the photosensitive drum 1 is rotated in the normal or reverse direction.

To describe in more detail, if the photosensitive drum 1 is rotated in the direction for image formation (positive direction) while the spring 37 (indicator portion 37*a*) in the above described state, the spring 37 is rotated by the friction between the spring 37 and drum shaft 36, in the same direction as the direction in which the photosensitive drum 1 is rotated. As a result, the indicator portion 37*a* hits the regulating portion 50*b* (first regulating portion), being thereby prevented from rotating further. Consequently, the spring 37 is subjected to such a force that acts in the direction to increase the internal diameter of the coiled portion 37*c*. In other words, the spring 37 is subjected to such a force that acts in the direction to reduce the coiled portion 37*c* in the amount of force by which it grips the drum shaft 36. Therefore, the drive shaft 36 is allowed to continue to rotate even through the spring 37 is prevented from rotating. Therefore, once the indicator portion 37*a* of the spring 37 is moved into the cleaning means container 50, that is, the second position, it remains therein, even if the photosensitive drum 1 is rotated in the positive direction.

On the other hand, if the photosensitive drum 1 rotates in the reverse direction, the spring 37 also rotates in the reverse direction. As a result, the positioning portion 37*b* of the spring 37 comes into contact with the regulating portion 50*a* (second regulating portion) of the cleaning means container 50, preventing the spring 37 from rotating further. Thus, the spring 37 is subjected to such a force that acts in the direction to increase the internal diameter of its coiled portion 37*c*. Consequently, the coiled portion 37*c* is reduced in the amount of force by which it grips the drum shaft 36, allowing the drum shaft 36 to continue to rotate even though the spring 37 is prevented from rotating. Therefore, the indicator portion 37*a* of the spring 37 remains in the position in which it indicates that the cartridge 7 has reached the end of its life.

As described above, once the spring 37 is moved into the second position, in which it indicates that the cartridge 7 has reached the end of its life, it is kept in the second portion by the first and second regulating portions 50*b* and 50*a*, regardless of whether the photosensitive drum 1 rotates in the positive or negative direction. In other words, it is ensured that the spring 37 remains in the state in which it informs a user that the cartridge 7 has reached the end of its life.

Incidentally, in this embodiment, the expiration of the life of the cartridge 7 is indicated by the spring 37. However, the information given by the spring 37 may be the information that the cartridge 7 has been used at least once for image formation. In such a case, the information that the cartridge 7 is brand-new is read from the storage means 44 by the control portion 43 shown in FIG. 2. Then, after the completion of the first image forming operation, the information that the cartridge 7 is brand-new is erased from the storage means 44, and the motor M is rotated in the reverse direction, moving thereby the spring 37 from the first position into the second position, to make it possible for a user to visually confirm that the cartridge 7 has been used for image formation.

Embodiment 2

Figure 21:
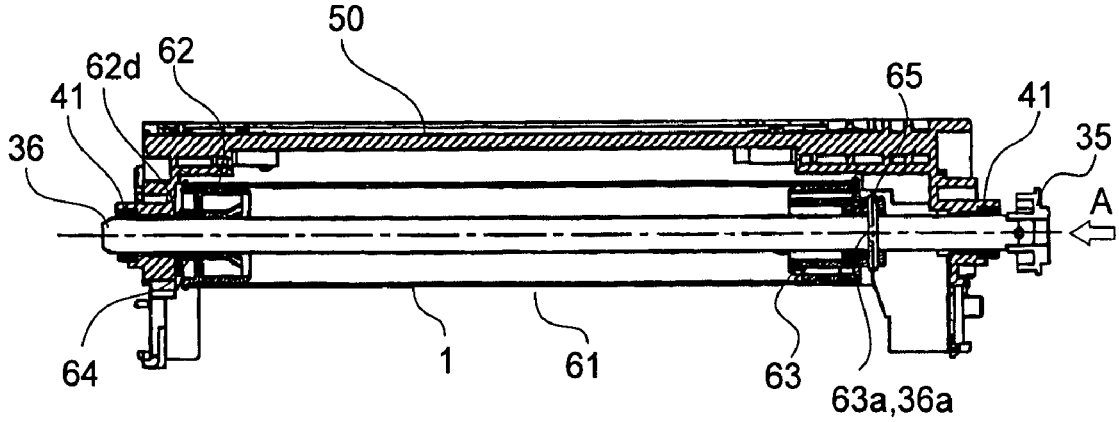
FIG. 21 is a sectional view of the process cartridge in the second embodiment of the present invention, at a plane parallel to the lengthwise direction of the process cartridge.

FIG. 21 shows a photosensitive drum unit 61 having a pair of flanges 62 attached to the lengthwise ends of its photosensitive drum 1 one for one. Each flange 62 is provided with a pair of notches 62*a* and 62*b*, and is firmly fixed to the photosensitive drum 1 by crimping the portions of the photosensitive drum 1, which correspond in position to the notches 62*a* and 62*b*. Incidentally, the method for firmly attaching the flange 62 to the photosensitive drum 1 may be press-fitting or bonding, instead of crimping.

The photosensitive drum unit 61 structured as described above is supported by a frame in the following manner. Referring to FIG. 21, a pair of drum bearings 41 are attached one for one to the lengthwise ends of the cleaning means container 50, and the photosensitive drum 1 is rotatably supported by the cleaning means container 50, by putting the drum shaft 36 through the pair of drum bearings 41 and the abovementioned pair of flanges 62 attached one for one to the lengthwise ends of the photosensitive drum 1. The flange 62 attached to one of the lengthwise ends of the photosensitive drum 1, and the drum shaft 36, are provided with a hole 63*a* and a hole 36*a*, respectively. Thus, by putting such a locking means 65 as a spring pin or a parallel pin through the holes 63*a* and 36*a*, the photosensitive drum unit 61 and drum shaft 36 are made to rotate together. As for the transmission of driving force to the photosensitive drum unit 61, the driving force is transmitted to the photosensitive drum unit 61 through a drum coupling 35 attached to one of the lengthwise ends of the drum shaft 36.

Figure 20:
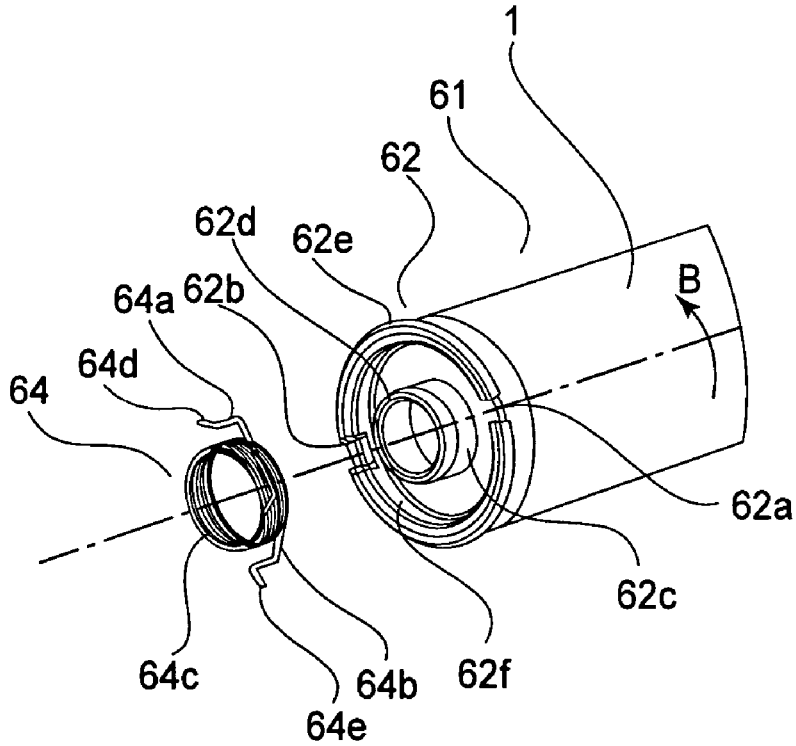
FIG. 20 is an exploded perspective view of the photosensitive drum unit in the second embodiment of the present invention.

Referring to FIGS. 20 and 21, the flange 62 is provided with a cylindrical portion 63*c*, through which the drum shaft 36 is put. The end surface 62*d* of the cylindrical portion 63*c* contributes to the positioning of the photosensitive drum unit 61 relative to the cleaning means container 50 in terms of the lengthwise direction of the photosensitive drum unit 61. Further, the cleaning means container 50 is provided with a positioning surface (unshown) for positioning the cleaning means container 50 relative to the image forming apparatus main assembly. Further, the cleaning means container 50 and photosensitive drum unit 61 are precisely positioned together relative to one side of the image forming apparatus by the pressure applied to the drum shaft 36 by the image forming apparatus main assembly (in direction indicated by arrow mark A in FIG. 21). In the normal image formation mode, the end surface 62*d* of the flange 62 rubs against the cleaning means container 50 while the photosensitive drum unit 61 rotates.

FIG. 20 shows the structures of a spring 64 and the components involved therewith, and their positional relationship. The spring 64 is attached to the cylindrical portion 62*c* of the flange 62. The spring 64 is has a coiled portion 64*c*, a first arm portion 64*a*, and a second arm portion 64*b*. The first arm portion 64*a* is provided with an indicator portion 64*d* for informing a user of the expiration of the life of the cartridge 7. The indicator portion 64*d* extends from the end of the first arm portion 64*a*. The second arm portion 64*b* is provided with a releasing portion 64*e* for loosening the spring 64. The releasing portion 64*e* extends from the end of the second arm portion 64*b*. The internal diameter of the coiled portion 64*c* of the spring 64 is set to a value smaller than that of the cylindrical portion 62*c* of the flange 62, as it was in the first embodiment. Thus, as the spring 64 is fitted around the flange 62, it is expanded in its radius direction, being thereby increased in diameter by the amount equal to the difference between its internal diameter and the external diameter of the cylindrical portion 62. The spring 64 is held by the cylindrical portion 62*c* while remaining in this expanded state.

In the second embodiment, the slidability of the flange 62 and coil spring 64 relative to each other is taken into consideration. Thus, the flange 62 is molded of POM (polyacetal resin). As the material for the spring 64, such a substance as hardened steel wire, stainless steel wire, or piano wire is used. However, the material combination is to be changed according to the life of a process cartridge, or the like factor; it does not need to be limited to the abovementioned ones. The flange 62 is designed so that the cylindrical portion 62*c* extends beyond the cylindrical portion 62*e* in terms of the lengthwise direction of the photosensitive drum 1. The distance by which the cylindrical portion 62*c* is to be made to extend beyond the cylindrical portion 62*e* is decided based on the diameter of the wire of which the spring 64 is formed, and the desired clearance between the cleaning means container 50 and the cylindrical portion 62*e* of the flange 62. On the other hand, the indicator portion 64*d* extending from the end of the first arm portion 64*a* of the spring 64 is roughly the same in position as the internal surface 62*f* of the flange 62, in terms of the radius direction of the flange 62. As for the second arm portion 64*b* of the spring 64, it is given such a size that allows it to fit in the inward side of the internal surface 62*b* of the flange 62. Thus, as the flange 62 is fitted with the spring 64, the indicator portion 64*d* of the spring 64 is positioned so that a preset amount of clearance is provided between the flange 62 and cleaning means container 50, in terms of the lengthwise direction of the photosensitive drum 1, whereas the second arm portion 64*b* is positioned within the hollow of the flange 62.

Figure 22:
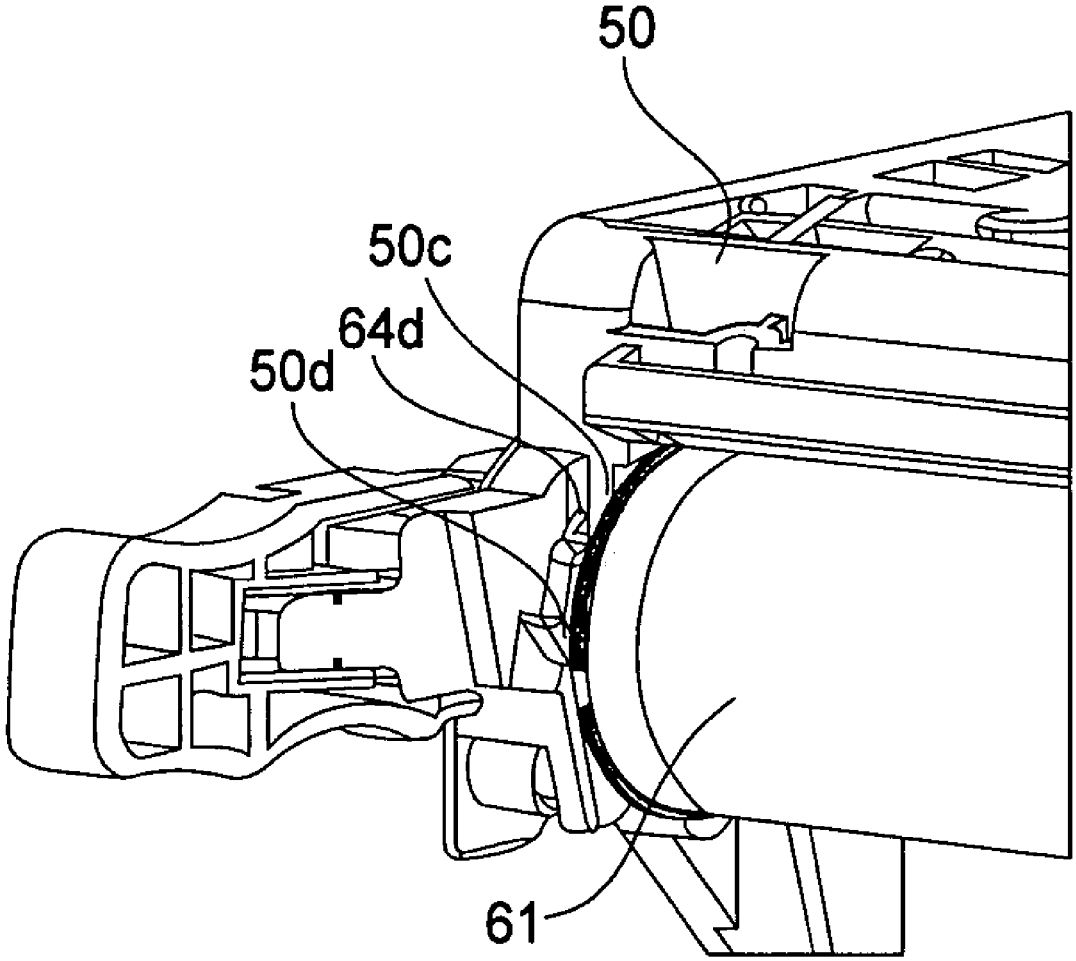
FIG. 22 is a perspective view of the process cartridge in the second embodiment of the present invention.
Figure 23:
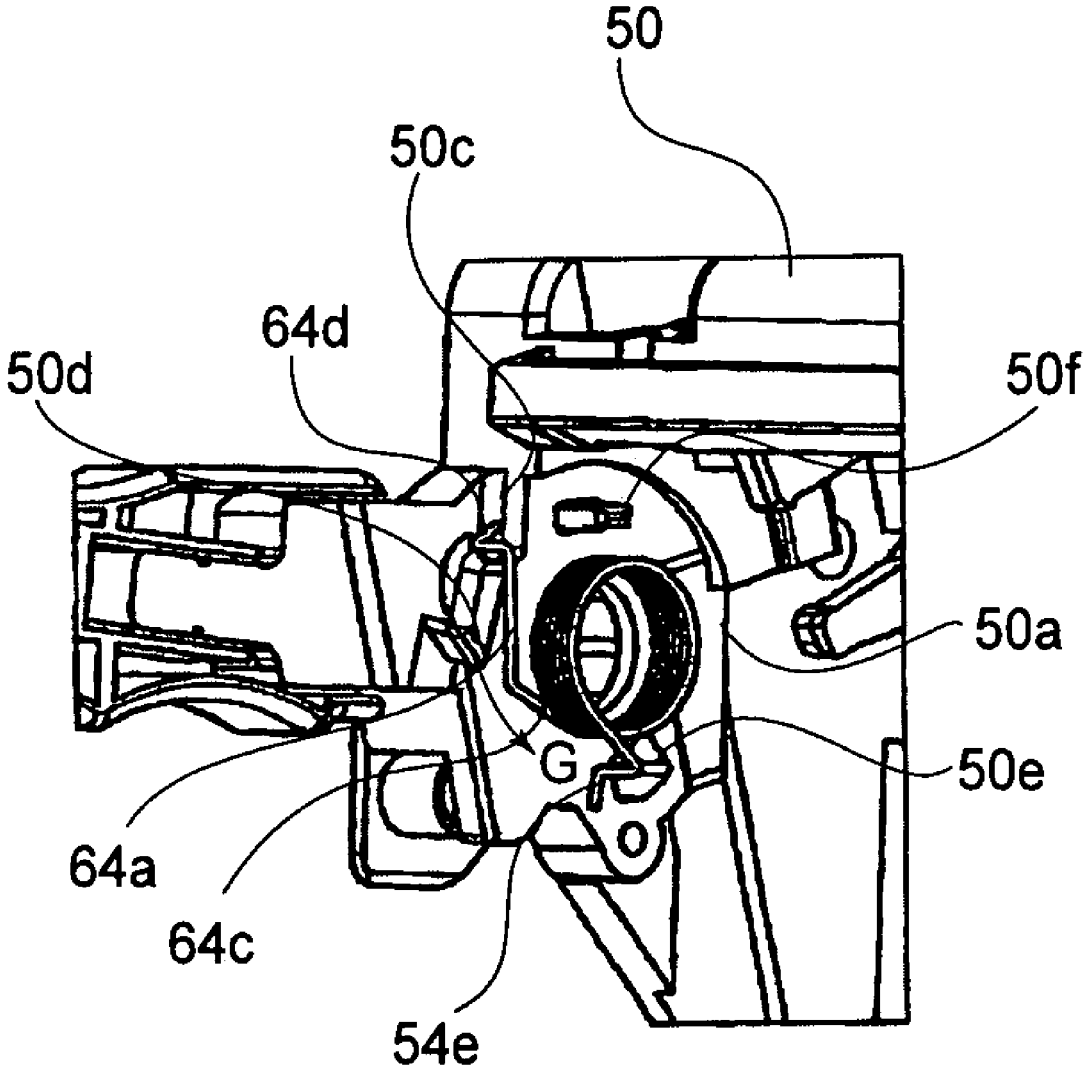
FIG. 23 is a partially cutaway perspective view of the process cartridge in the second embodiment of the present invention.

Referring to FIGS. 22 and 23, the cleaning means container 50 is provided with a regulating wall 50*c* which regulates the position of the indicator portion 64*d* of the spring 64. Further, the cleaning means container 50 is provided with a guiding surface 50*d* as the portion by which the first arm portion 64*a* and indicator portion 64*d* are guided when they are moved to inform a user of the expiration of the cartridge life. Moreover, the cleaning means container 50 is provided with a holding recess 50*e* in which the indicator portion 64*d* is held to inform a user of the expiration of the cartridge life, and a regulating projection 50*f* which regulates the position of the second arm portion 64*b*. In this embodiment, however, the regulating projection 50*f* for regulating the position of the second arm portion 64*b* is not a part of the cleaning means container 50; it is a component formed independently from the cleaning means container 50.

Figure 24:
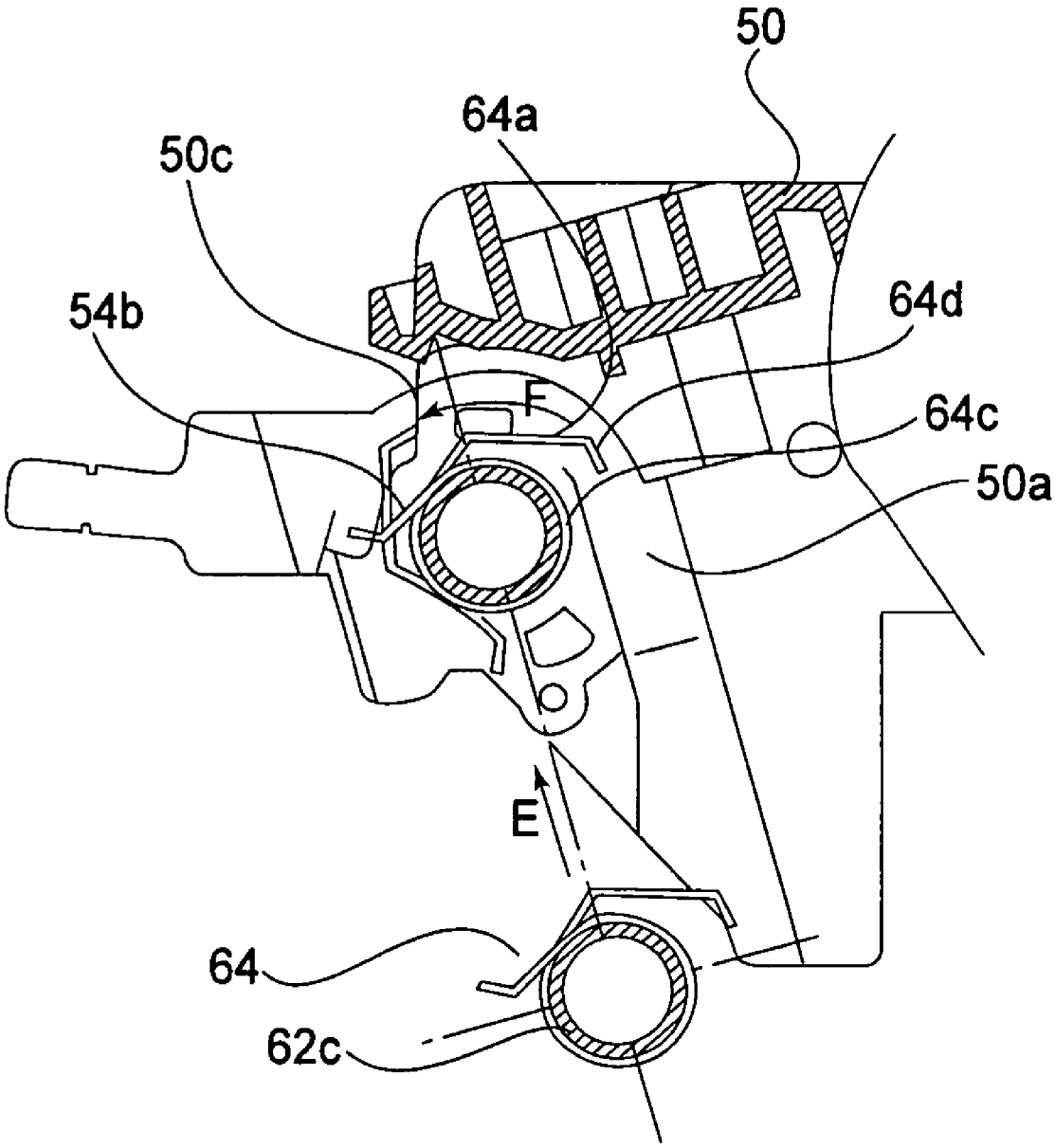
FIG. 24 is a sectional view of a part of the process cartridge in the second embodiment of the present invention, showing one of the steps in the process for assembling the process cartridge.

Next, referring to FIG. 24, the assembly sequence to be followed to attach the photosensitive drum unit 61 and spring 64 will be described. Although the flange 62 is not shown in its entirety in the drawing, the photosensitive drum unit 61 inclusive of the spring 64 is to be attached in entirety to the cleaning means container 50. More specifically, the photosensitive drum unit 61 is to be moved into the cleaning means container 50 from the direction indicated by an arrow mark E in the drawing, after the spring 64 is attached to the flange 62 of the photosensitive drum unit 61. Then, the drum shaft 36 is to be put through the bearings 41 and drum unit 61, with the photosensitive drum unit 61 held so that the axial line of the drum unit 61 coincides with those of the bearings 41 attached to the cleaning means container 50. Then, the spring pin 65 is to be put through the hole 63*a* of the flange 62 and the hole 36*a* of the drum shaft 36, to lock the photosensitive drum unit 61 to the drum shaft 36 (FIG. 21).

Thereafter, the photosensitive drum unit 61 is to be rotated in the direction (indicated by arrow mark F in drawing) opposite to the direction in which it is rotated for image formation. As the photosensitive drum unit 61 is rotated in the abovementioned direction, the coiled portion 64*c* of the spring 64 is made to tighten by the force which acts on the first arm portion 64*a* in the direction to resist the movement of the first arm portion 64*a*. As a result, the spring 64 begins to rotate with the photosensitive drum unit 61 in a manner to wrap itself around the cylindrical portion 62*c* of the flange 62. The cleaning means container 50 is provided with a slanted surface 50*g* used for attaching the spring 64 (FIGS. 23 and 24). The slanted surface 50*g* is slanted in such a direction that, in terms of the direction (indicated by arrow mark F in FIG. 24) in which the photosensitive drum unit 61, to which the spring 64 has been attached, is to be rotated to be attached to the cleaning means container 50, the upstream side of the slanted surface 50*g* is on the inward side of the cleaning means container 50 in terms of the lengthwise direction of the cleaning means container 50. Therefore, as the photosensitive drum unit 61 is reversely rotated, the first arm portion 64*a* and indicator portion 64*d* is pushed by the slanted surface 50*g*, inward of cleaning means container 50, that is, inward of the flange 62, in terms of the lengthwise direction of the cleaning means container 50. In terms of the radius direction of the spring 64, the first arm portion 64*a* and indicator portion 64*d* are pushed inward of the flange 62 due to the resistance between them and cleaning means container 50. Thus, the first arm portion 64*a* and indicator portion 64*d* of the spring 64 rotate with the photosensitive drum unit 61 while moving inward of the internal surface 62*f* of the flange 62. Then, as the photosensitive drum unit 61 is further rotated in reverse, the indicator portion 64*d* moves onto, and beyond, the regulating wall 50*c* of the cleaning means container 50. As soon as the indicator portion 64*d* moves beyond the regulative wall 50*c*, the first arm portion 64*a* and indicator portion 64*d* are freed. As a result, the spring 64 tightens, being thereby precisely positioned relative to the flange 62. This ends the assembly sequence (area contoured in drawing by two-dot chain line shows where spring 64 is after completion of assembly sequence).

Referring to FIG. 22, at the completion of the assembly, the indicator portion 64*d* of the spring 64 is exposed from the cartridge 7. From when the assembly is completed to when the cartridge 7 reaches the end of its life, the indicator portion 64*d* of the spring 64 remains in the position (second position) shown in FIG. 22. In other words, the indicator portion 64*d* is positioned so that even when the cartridge 7 is outside the main assembly of an image forming apparatus, a user can confirm whether or not the cartridge 7 has reached the end of its life.

Next, referring to each of FIG. 22, and 25-28, the movements of the spring 64, which occur from when the process cartridge begins to be used, to when the indicating portion 64*d* of the spring 64 is moved into the position for informing a user of the expiration of cartridge life, will be described.

First, referring to FIG. 22, while an image is formed, the photosensitive drum unit 61 is rotating in the positive direction. During this period, the indicator portion 64*d* of the spring 64 is regulated in position by the regulating wall 50*c* of the cleaning means container 50, causing thereby the spring 64 to remain stationary while allowing the cylindrical portion 62*c* of the flange 62 to rotate.

In the second embodiment, the spring 64 is such a coil spring that its coiled portion 64*c* was wound rightward. Its internal diameter is set to a value which is 0.2 mm smaller than the external diameter of the cylindrical portion 62*c* of the flange 62. The force by which the coiled portion 64 *c* grips the cylindrical portion 62*c* is a static force generated by designing the spring 64 so that prior to the attachment of the spring 64 to the cylindrical portion 62*c*, the internal diameter of the coiled portion 64*c* is smaller than the external diameter of the cylindrical portion 62*c*, as in the first embodiment. Therefore, as the photosensitive drum unit 61 rotates in the positive direction, the spring 64 rotates with the flange 62 due to the presence of the friction generated between the spring 64 and the cylindrical portion 62*c* of the flange 62 by this gripping force of the spring 64. However, as the spring 64 further rotates with the photosensitive drum unit 61, the indicator portion 64*d* of the spring 64 comes into contact with the regulating portion 50*c* of the cleaning means container 50, being prevented from rotating further. As the indicator portion 64*d* is prevented from rotating further, the coil portion 64*c* is increased in internal diameter, because of the direction in which the coiled portion 64*c* of the spring 64 was wound. As a result, the friction between the coiled portion 64*c* and cylindrical portion 62*c* is reduced, allowing the flange 62 to rotate while the spring 64 is kept stationary.

Therefore, from when the assembly of the process cartridge 7 is completed to when the process cartridge 7 reaches the end of its life, the indicator portion 64*d* of the spring 64 remains in the first position. Therefore, even when the cartridge 7 is out of the image forming apparatus main assembly, a user can visually determine whether or not the cartridge 7 has reached the end of its life.

Figure 25:
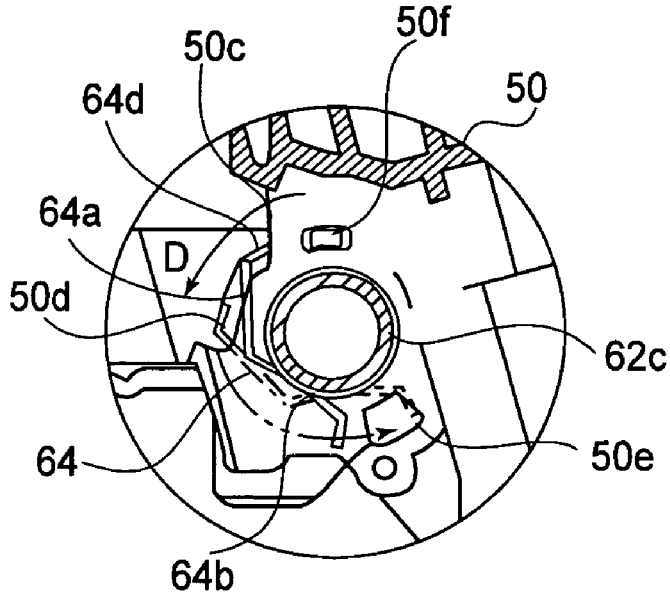
FIG. 25 is a perspective view of the process cartridge in the second embodiment of the present invention.
Figure 26:
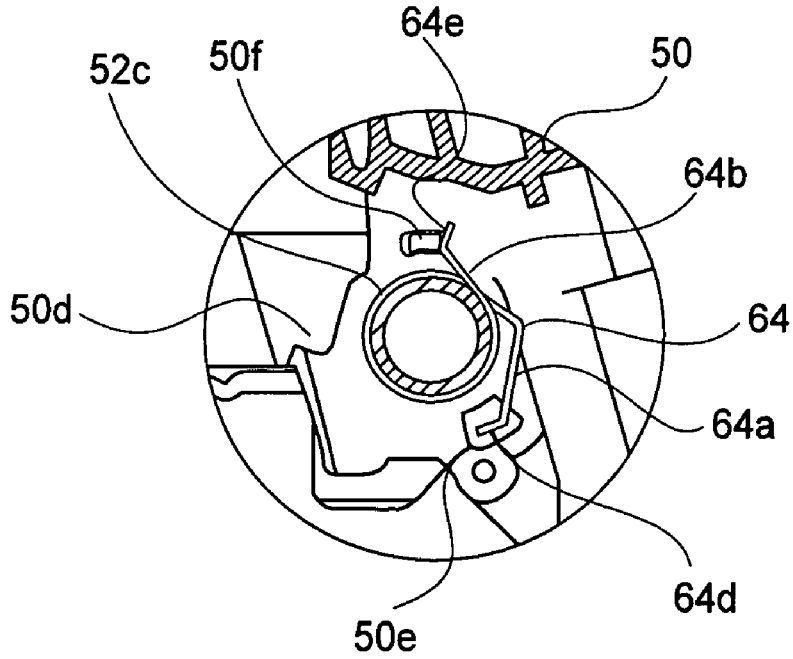
FIG. 26 is a partially sectional side view of the process cartridge in the second embodiment of the present invention.
Figure 27:
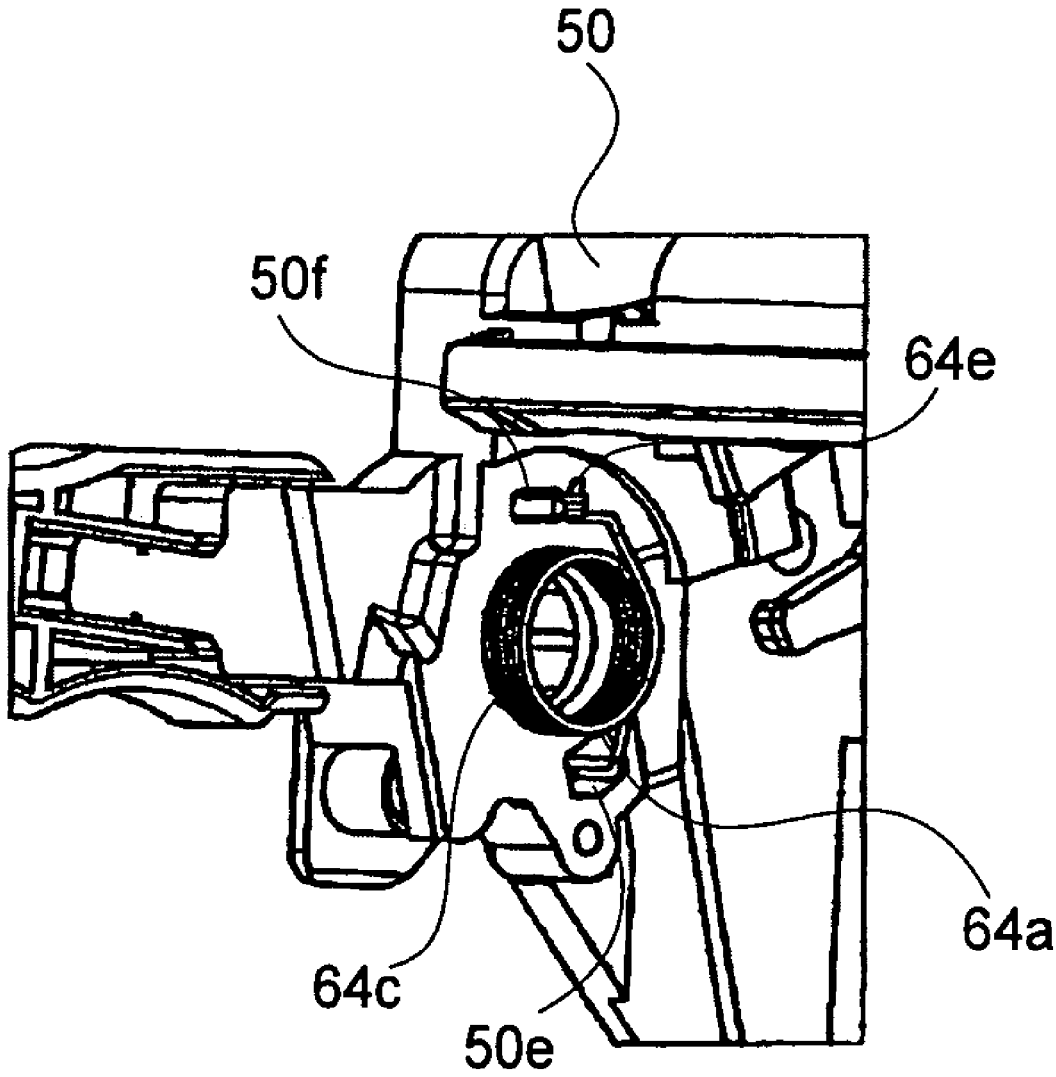
FIG. 27 a partially cutaway perspective view of the process cartridge in the second embodiment of the present invention.
Figure 28:
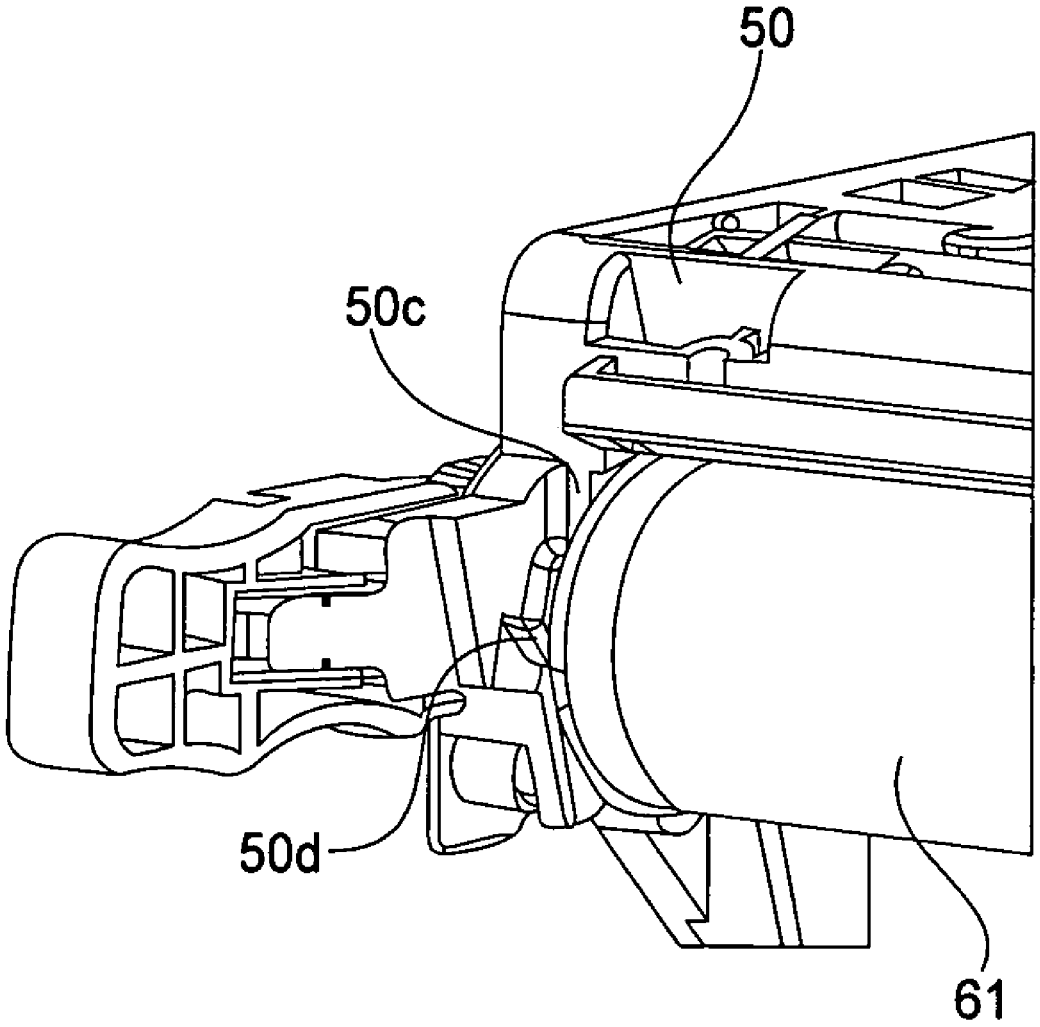
FIG. 28 is a perspective view of the process cartridge in the second embodiment of the present invention.

As the main assembly 100 of the image forming apparatus determines that the cartridge 7 has reached the end of its life, it rotates the photosensitive drum unit 61 by a preset amount in the reverse direction (indicated by arrow mark D in FIG. 25). During this reverse rotation of the photosensitive drum unit 61, the indicator portion 64*d* is moved away from the regulating wall 50*c*, allowing thereby the coiled portion 62*c* of the spring 64 to tighten around the cylindrical portion 62*c* of the flange 62. As a result, the spring 64 and photosensitive drum unit 61 begin to rotate together. Incidentally, the force which causes the coiled portion 64*c* to grip the cylindrical portion 62*c* is a static force like that in the above described first embodiment. That is, it is the force generated in the coiled portion 64*c* as the coiled portion 64*c* is reduced in internal diameter by the rotation of the cylindrical portion 62*c*. During this period, the indicator portion 64*d* moves along the guiding surface 50*d* of the cleaning means container 50 (as indicated by arrow mark G in FIG. 23). As a result, the indicator portion 64*c* falls inward of the cartridge 7 in the lengthwise direction of the cartridge 7, and moves into the holding recess 50*e* of the cleaning means container 50 while moving inward of the internal surface 62*f* of the flange 62 (second position). Referring to FIG. 27, the holding recess 50*e* is shaped as shown in FIG. 27. Therefore, as the first arm portion 64*a* and indicator portion 64*d* reach the holding recess 50*e*, the first arm portion 64*a* is freed from the guiding surface 50*d*. As a result, the movement thereafter of the first arm portion 64*a* is regulated by the wall surface of the holding recess 50*e*. Therefore, a contact portion 64*e*, with which the second arm portion 64*b* of the spring 64 is provided, comes into contact with the regulating projection 50*f* of the cleaning means container 50, as shown in FIGS. 26 and 27. Consequently, the coiled portion 64*c* of the spring 64 is loosened. Thereafter, even if the photosensitive drum unit 61 rotates further in the reverse direction, the spring 64 remains in the same position while allowing the photosensitive drum unit 61 to rotate in the reverse direction.

As a result, the indicator portion 64*d* of the spring 64 moves into the position in which the indicator portion 64*d* is not visible from outside the cartridge 7. Thus, one glance at the cartridge 7 is enough for a user to find out whether or not the cartridge 7 has reached the end of its life.

Here, the first arm portion 64*a* and indicator portion 64*d* of the spring 64 are regulated in position by the holding recess 50*e*, as in the first embodiment. Therefore, even if the photosensitive drum unit 61 rotates in the positive direction after it is rotated in the reverse direction, the first arm portion 64*a* and indicator portion 64*d* never move into a position in which they are visible from outside the cartridge 7, and therefore, never does it occur that a user is misinformed.

Incidentally, the information to be given by the spring 37 may be that cartridge 7 has been used at least once for image formation.

As described above, in the first and second embodiments, the drum shaft is utilized, eliminating the need for providing the image forming apparatus main assembly 100 with an apparatus dedicated to informing a user of the expiration of the cartridge life. Further, it is possible to inform a user that the cartridge 7 has been used at least once for image formation.

The informing member is made up of the spring attached to the drum shaft of the photosensitive drum, and the spring is held to the drum shaft only by the force generated in the spring in the direction to tighten the spring around the drum shaft. Therefore, the only effect the informing member has upon the drum shaft is a preset amount of resistance (load) attributable to the friction between the informing member and drum shaft. In other words, the informing member does not cause an external disturbance, more specifically, change in the load which applies to the drum shaft. Therefore, it does not adversely affect the accuracy with the photosensitive drum is driven, having therefore no effect upon levels of quality at which an image is formed.

Also, as described above, the informing member is made up of only the spring attached to the drum shaft, enjoying therefore the merit of being small and inexpensive. Further, regardless of whether the photosensitive drum is rotated in the positive or negative direction after the informing of the expiration of the cartridge life, the rotation of the coil spring is regulated by the contact between one end of the coil spring and the rotation regulating portion. Therefore, the coil spring remains in the state in which it shows that the cartridge 7 has reached the end of its life. In other words, the informing member in accordance with the present invention is highly reliable.

In the above, the present invention was described in the form of the first and second embodiments of the present invention. However, the first and second embodiments are not intended to limit the scope of the present invention. That is, the present invention may be embodied in various forms other than the above described ones, as long as they remains within the gist of the present invention. For example, it may be embodied in the form of modifications of the first and second embodiments, embodiments in which the first and/or second embodiment is utilized.

According to the present invention, as a process cartridge is used at least once for image formation, the electrostatic photosensitive drum receives from the apparatus main assembly, such driving force that rotates the drum shaft in the direction opposite to the direction in which the photosensitive drum rotates for image formation. The resultant rotation of the drum shaft moves the informing member into a preset position so that one glance is enough for a user to confirm that the process cartridge has reached the end of its life.

The informing member can be moved by rotating the drum shaft in the reverse direction, eliminating the need for a driving system dedicated to moving the informing member. Therefore, it is possible to realize a small and inexpensive mechanism for informing a user that a process cartridge has been used at least once for image formation.

While the invention has been described with reference to the structures disclosed herein, it is not confined to the details set forth, and this application is intended to cover such modifications or changes as may come within the purposes of the improvements or the scope of the following claims.

This application claims priority from Japanese Patent Applications Nos. 029891/2005 and 024062/2006 filed Feb. 4, 2005 and Feb. 1, 2006, respectively which are hereby incorporated by reference.

What is claimed is:

1. A process cartridge detachably mountable to a main assembly of an electrophotographic image forming apparatus for forming an image on a recording material, said process cartridge comprising:

an electrophotographic photosensitive drum;

a drum shaft configured and positioned to be rotated by a driving force supplied from the main assembly of the apparatus and to transmit a rotating force to said electrophotographic photosensitive drum; and an indicator, movably provided on said drum shaft, configured and positioned to indicate when said process cartridge is mounted to said main assembly of the apparatus, that said process cartridge has reached at least a state that said process cartridge has been used for image formation, wherein when the main assembly of the apparatus detects that said process cartridge has reached the state, said drum shaft is rotated in a direction opposite to a rotational direction for the image formation to activate said indicator.

2. A process cartridge according to claim 1, wherein said indicator includes a spring mounted on said drum shaft and is provided with a fixed portion engaged with an outer surface of said drum shaft, and wherein said spring is wound in a direction such that when said drum shaft rotates in the opposite direction, an inner diameter thereof decreases.

3. A process cartridge according to claim 1 or 2, further comprising a frame supporting said electrophotographic photosensitive drum, wherein said indicator has a display portion movable between a first position in which said indicator is exposed through an opening provided in said frame to be visible from an outside of said process cartridge and a second position in which said indicator is accommodated in said frame to be invisible from the outside when said drum shaft is rotated in the opposite direction.

4. A process cartridge according to claim 3, wherein said frame includes a first regulating portion configured and positioned to prevent said display portion from moving to said first position by abutting to said display portion when said drum shaft rotates in the direction for said image formation after said display portion moves to the second position.

5. A process cartridge according to claim 3, wherein said frame has a second regulating portion configured and positioned to prevent said display portion from moving to said first position by abutting said spring when said drum shaft rotates in the opposite direction after said display portion is moved to said second position.

6. A process cartridge according to claim 1, wherein the state is indicative of said process means reaching the end of its service life.

7. An electrophotographic image forming apparatus for forming an image on a recording material, wherein a process cartridge is detachably mountable thereto, said apparatus comprising:

(i) a motor;

(ii) control means for controlling a rotational direction of a motor on the basis of detection of a state of the process cartridge; and (iii) mounting means for detachably mounting the process cartridge, the process cartridge including:

an electrophotographic photosensitive drum;

a drum shaft configured and positioned to be rotated by a driving force supplied from the main assembly of said apparatus and to transmit a rotating force to the electrophotographic photosensitive drum; and an indicator, movably provided on the drum shaft, configured and positioned to indicate when the process cartridge is mounted to the main assembly of the apparatus, that the process cartridge has reached at least a state that the process cartridge has been used for image formation, wherein when said control means detects that the process cartridge has reached the state, the drum shaft is rotated in a direction opposite to a rotational direction for the image formation to activate said indicator; and feeding means for feeding the recording material.

8. A process cartridge detachable mountable to a main assembly of an electrophotographic image forming apparatus for forming an image on a recording material, said process cartridge comprising:

an electrophotographic photosensitive drum;

a movable indicator for indicating, when said process cartridge is mounted to said main assembly of the apparatus, that the process cartridge has reached at least a state that the process cartridge has been used for image formation, wherein when said main assembly of the apparatus detects that the process has reached the state, said electrophotographic photosensitive drum is rotated in a direction opposite to a rotational direction for the image formation to activate said indicator.

* * * * *

UNITED STATES PATENT AND TRADEMARK OFFICE

CERTIFICATE OF CORRECTION

PATENT NO. : 7,386,241 B2
APPLICATION NO. : 11/346174
DATED : June 10, 2008
INVENTOR(S) : Tomonori Mori et al.

It is certified that error appears in the above-identified patent and that said Letters Patent is hereby corrected as shown below:

COLUMN 1
Line 47, “cumulatively” should read --cumulative--.
Line 61, “above” should read --above- --.

COLUMN 5
Line 43, “an” should read --a--.

COLUMN 6
Line 49, “communicate,” should read --communicates,--.
Line 67, “coincide” should read --coincides--.

COLUMN 7
Line 62, “above described” should read --above-described--.

COLUMN 8
Line 6, “above described” should read --above-described--.
Line 53, “above” should read --above- --.
Line 59, “above” should read --above- --.

COLUMN 10
Line 63, “above” should read --above- --.

COLUMN 12
Line 17, “above described” should read --above-described--.
Line 38, “above” should read --above- --.

COLUMN 14
Line 11, “is” should be deleted.

COLUMN 16
Line 27, “64 c” should read --64c--.
Line 66, “above described” should read --above-described--.

COLUMN 18
Line 11, “above described” should read --above-described--, and “remains” should read --remain--.

UNITED STATES PATENT AND TRADEMARK OFFICE

CERTIFICATE OF CORRECTION

PATENT NO. : 7,386,241 B2
APPLICATION NO. : 11/346174
DATED : June 10, 2008
INVENTOR(S) : Tomonori Mori et al.

It is certified that error appears in the above-identified patent and that said Letters Patent is hereby corrected as shown below:

COLUMN 20
Line 19, "detachable" should read --detachably--.

Signed and Sealed this

Third Day of February, 2009

John Doll

JOHN DOLL
*Acting Director of the United States Patent and Trademark Office*